US006082386A

United States Patent [19]

Zheng

[11] Patent Number: 6,082,386

[45] Date of Patent: Jul. 4, 2000

[54] VERTICALLY STACKED COLLAPSIBLE STRUCTURES

[75] Inventor: Yu Zheng, Covina, Calif.

[73] Assignee: Patent Category Corp., Walnut, Calif.

[21] Appl. No.: 09/207,183

[22] Filed: Dec. 9, 1998

[51] Int. Cl.[7] ..... E04H 15/40

[52] U.S. Cl. ..... 135/126; 135/143; 135/119; 473/471; 482/35; 273/397

[58] Field of Search ..... 135/125, 126–128, 135/143, 97, 117, 119; 473/471, 479, 433; 273/397, 396, 402, 393; 446/476, 487, 119; 482/35, 148

[56] References Cited

U.S. PATENT DOCUMENTS

| | | | |
|---|---|---|---|
| 4,635,411 | 1/1987 | Kurzen . | |
| 4,815,784 | 3/1989 | Zheng . | |
| 5,038,812 | 8/1991 | Norman . | |
| 5,137,044 | 8/1992 | Brady . | |
| 5,467,794 | 11/1995 | Zheng | 135/125 |
| 5,560,385 | 10/1996 | Zheng | 135/125 |
| 5,711,253 | 1/1998 | Phillips et al. | 119/706 |
| 5,722,446 | 3/1998 | Zheng . | |
| 5,778,915 | 7/1998 | Zheng | 135/126 |
| 5,816,954 | 10/1998 | Zheng . | |

FOREIGN PATENT DOCUMENTS 2015649 2/1971 Germany .

*Primary Examiner*—Carl D. Friedman
*Assistant Examiner*—Winnie Yip
*Attorney, Agent, or Firm*—Raymond Sun

[57] ABSTRACT

Collapsible structures are provided having at least one lower panel, each panel having a foldable frame member having a folded and an unfolded orientation, with a fabric material substantially covering the frame member to form the panel when the frame member is in the unfolded orientation. The fabric assumes the unfolded orientation of its frame member, and each panel further includes a first side, a second side, a bottom side and a top side. The first side of one panel is coupled to the second side of an adjacent panel. The collapsible structure according to the present invention further includes an upper panel having a bottom side coupled to the top side of one of the lower panels. In other embodiments, at least two upper panels are provided, with the upper panels provided above the lower panels. The respective panels can be coupled to each other using stitching and/or detachable connectors, or by crossing the frame members of the panels at adjacent left, right, top or bottom sides.

25 Claims, 38 Drawing Sheets

VERTICALLY STACKED COLLAPSIBLE STRUCTURES

BACKGROUND OF THE INVENTION

1. Field of the Invention

The present invention relates to collapsible structures, and in particular, to collapsible play structures which may be provided in a variety of shapes and sizes. The collapsible play structures may be twisted and folded to reduce the overall size of the play structures to facilitate convenient storage and use.

2. Description of the Prior Art

Two important considerations for all toys or play things targeted for children and adults are convenience and variety. Relating to convenience, a toy must be easily transportable so that the user can move it around the home, or even to other places outside of the home. A toy must also be easily stored since an adult or child is likely to have many other toys or objects that compete for precious storage space in the home. As for variety, a toy must offer enough variety in play so that the child or adult will be able to enjoy it for a long period of time without getting bored.

Larger toys often pose a greater problem with regards to convenience. The larger toys tend to be bulky, which makes it difficult to move them around the home, and sometimes makes it prohibitive to move them outside the house to other locations. Bulky toys also take up much storage space. For these reasons, many executive toys targeted for adults are made in small sizes.

Collapsible play structures have recently become popular with both adults and children. Examples of such structures are shown and described in U.S. Pat. Nos. 5,038,812 (Norman), 5,467,794 (Zheng) and 5,560,385 (Zheng). These structures have a plurality of panels that may be twisted and folded to reduce the overall size of the structures to facilitate convenient storage and use. As such, these structures are being enjoyed by many people in many different applications.

For example, these structures have been provided in many different shapes and sizes for children's play inside and outside the house. Smaller versions of these structures have been used as infant nurseries. Even smaller versions of these structures have been used as dollhouses and action figure play houses by toddlers and children.

As another example, these structures have been made into tents or outdoor structures that can be used by adults and children for camping or other outdoor purposes. These structures have also been popular as beach cabanas.

Even animals can enjoy these structures. Some of these structures have been made into shelters that can be used by pets, both inside and outside the house.

The wide-ranging uses for these collapsible structures can be attributed to the performace, convenience and variety that these structures provide. When fully expanded, these structures are stable and can be used as a true shelter without the fear of collapse. These structures are easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

However, the separate panels of most of these collapsible structures cannot be provided in sizes that are too large, since larger panels have less stability and are more difficult to twist and fold during the collapsing steps. As a result, the heights of these structures tend to be limited, thereby limiting the applications to which they can be used.

Thus, there still remains a need for collapsible structures that can be provided with increased height to increase the variety of play, entertainment value, and utility for such structures.

SUMMARY OF THE DISCLOSURE

The present invention provides collapsible structures having an increased height to allow structures of greater heights to be provided, thereby increasing the variety of play, entertainment value, and utility for these structures. These collapsible structures can be easily and quickly folded and collapsed into a compact configuration. As a result, the collapsible structures according to the present invention are convenient to use, to move around, and to store, thereby making them ideal for use at home, at the office as an executive toy, and at many other locations.

In order to accomplish the objects of the present invention, the collapsible structures according to the present invention have, in their most basic embodiment, at least one lower panel, each panel having a foldable frame member having a folded and an unfolded orientation, with a fabric material substantially covering the frame member to form the panel when the frame member is in the unfolded orientation. The fabric assumes the unfolded orientation of its frame member, and each panel further includes a first side, a second side, a bottom side and a top side. The first side of one panel is coupled to the second side of an adjacent panel. The collapsible structure according to the present invention further includes an upper panel having a bottom side coupled to the top side of one of the lower panels.

In other embodiments, at least two upper panels are provided, with the upper panels provided above the lower panels. The respective panels can be coupled to each other using stitching and/or detachable connectors, or by crossing the frame members of the panels at adjacent left, right, top or bottom sides.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The collapsible structures according to the present invention are provided with a height having two or more panels to increase the overall height and stability of the structures. These structures can be folded and collapsed into a compact configuration for convenient storage and transportation.

Figure 1:
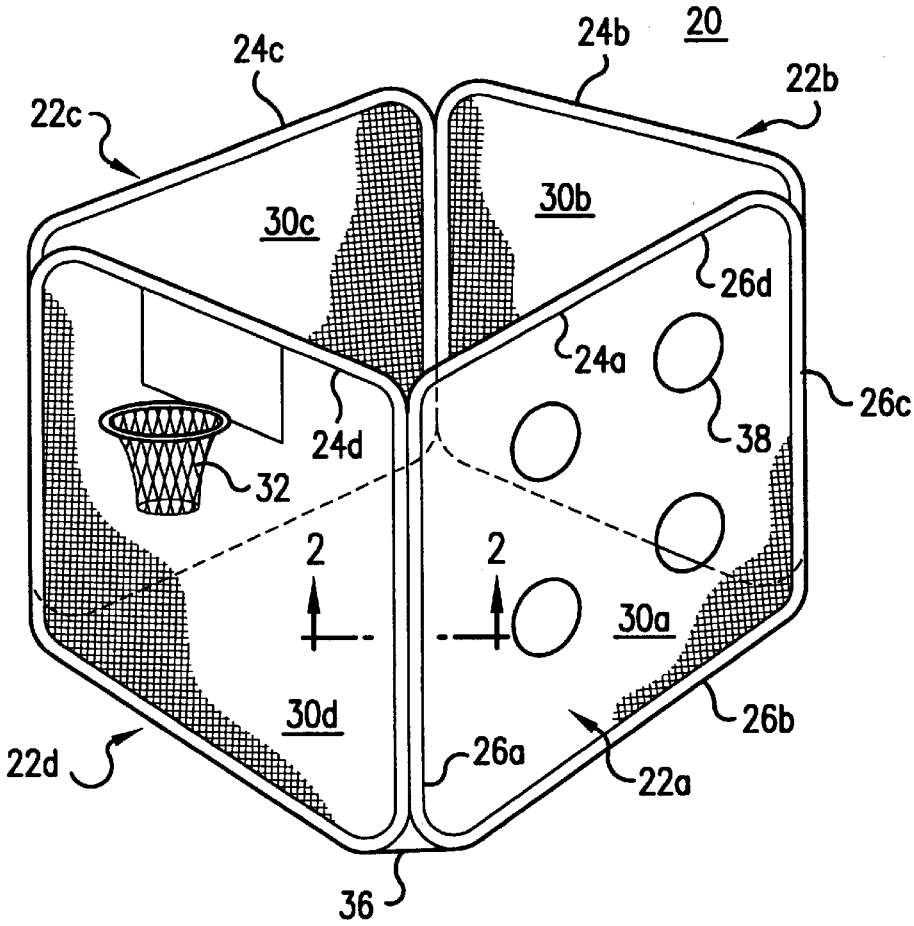
FIG. 1 is a perspective view of one module of a collapsible structure according to a preferred embodiment of the present invention.
Figure 1A:
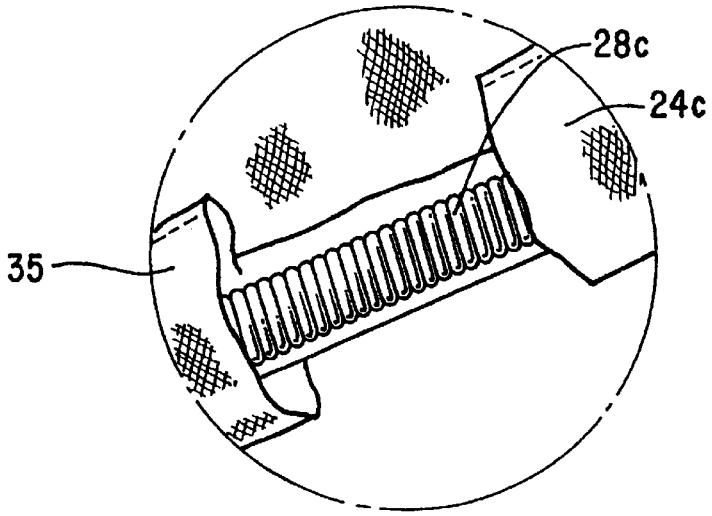
FIG. 1A is a partial cut-away view of the section A of the structure of FIG. 1 illustrating a frame member retained within a sleeve.

FIGS. 1 and 1A illustrate a possible basic component for a collapsible structure according to the present invention which takes the form of a module 20. As explained in greater detail hereinbelow, the collapsible structures according to the present invention can each be comprised of one or more of these modules 20 (or any of the modules shown in FIGS. 18A, 26 or 27) assembled to create a resulting structure having the desired shape and size.

Referring to FIG. 1, according to a first preferred embodiment of the present invention, each module 20 comprises four side panels 22*a*, 22*b*, 22*c* and 22*d* connected to each other to encircle an enclosed space. Each side panel 22*a*, 22*b*, 22*c* and 22*d* has four sides, a left side 26*a*, a bottom side 26*b*, a right side 26*c* and a top side 26*d*. Each side panel 22*a*, 22*b*, 22*c* and 22*d* has a continuous frame retaining sleeve 24*a*, 24*b*, 24*c* or 24*d*, respectively, provided along and traversing the four edges of its four sides 26*a*, 26*b*, 26*c* and 26*d*. A continuous frame member 28*a*, 28*b*, 28*c* or 28*d* is retained or held within each frame retaining sleeve 24*a*, 24*b*, 24*c* or 24*d*, respectively, to support each side panel 22*a*, 22*b*, 22*c* and 22*d*. Only the frame member 28*c* is shown in FIG. 1A; the other frame members 28*a*, 28*b* and 28*d* are not shown but are the same as frame member 28*c*.

The continuous frame members 28*a*, 28*b*, 28*c* and 28*d* may be provided as one continuous loop, or may comprise a strip of material connected at both ends to form a continuous loop. The continuous frame members 28*a*, 28*b*, 28*c* and 28*d* are preferably formed of flexible coilable steel having a memory, although other materials such as plastics may also be used. The frame members should be made of a material which is relatively strong and yet is flexible to a sufficient degree to allow it to be coiled. Thus, each frame member 28*a*, 28*b*, 28*c* and 28*d* is capable of assuming two positions or orientations, an open or expanded position such as shown in FIG. 1, or a folded position in which the frame member is collapsed into a size which is much smaller than its open position (see FIG. 3(E)).

Fabric or sheet material 30*a*, 30*b*, 30*c* and 30*d* extends across each side panel 22*a*, 22*b*, 22*c* and 22*d*, respectively, and is held taut by the respective frame members 28*a*, 28*b*, 28*c* and 28*d* when in its open position. The term fabric is to be given its broadest meaning and should be made from strong, lightweight materials and may include woven fabrics, sheet fabrics or even films. The fabric should be water-resistant and durable to withstand the wear and tear associated with rough treatment by children. The frame members 28*a*, 28*b*, 28*c* and 28*d* may be merely retained within the respective frame retaining sleeves 24*a*, 24*b*, 24*c* and 24*d*, respectively, without being connected thereto. Alternatively, the frame retaining sleeves 24*a*, 24*b*, 24*c* and 24*d* may be mechanically fastened, stitched, fused, or glued to the frame members 28*a*, 28*b*, 28*c* and 28*d*, respectively, to retain them in position.

Figure 2A:
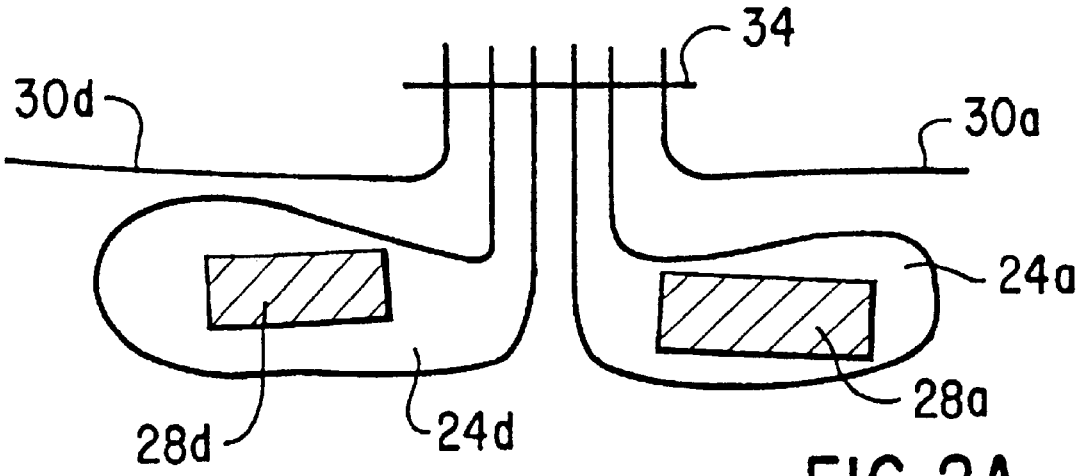
FIG. 2A is a cross-sectional view of a first preferred connection between two adjacent panels of the structure of FIG. 1 taken along line 2—2 thereof.

FIG. 2A illustrates one preferred connection for connecting adjacent edges of two side panels 22*a* and 22*d*. The fabric pieces 30*a* and 30*d* are stitched at their edges by a stitching 34 to the respective sleeves 24*a* and 24*d*. Each sleeve 24*a* and 24*d* may be formed by folding a piece of fabric. The stitching 34 also acts as a hinge for the side panels 22*a* and 22*d* to be folded upon each other, as explained below. The connections for the three other pairs of adjacent edges may be identical. Thus, the connections on the left side 26*a* and the right side 26*c* of each side panel 22*a*, 22*b*, 22*c* and 22*d* act as hinge connections for connecting an adjacent side panel.

At the top side 26*d* and the bottom side 26*b* of each side panel 22*a*, 22*b*, 22*c* and 22*d*, where there is no hinge connection to an adjacent side panel, the frame retaining sleeve 24*a*, 24*b*, 24*c* or 24*d* may be formed by merely folding over the corresponding fabric piece and applying a stitching 35 (see FIG. 1A). The fabric piece for the corresponding side panel may then be stitched to the sleeve.

Figure 2B:
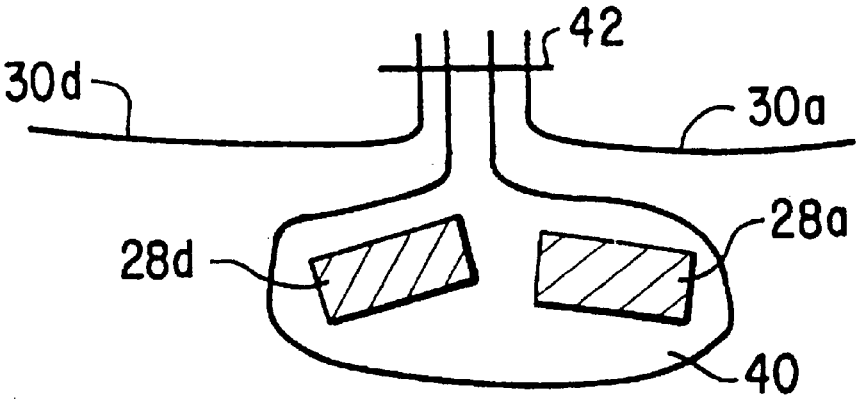
FIG. 2B is a cross-sectional view of a second preferred connection between two adjacent panels of the structure of FIG. 1 taken along line 2—2 thereof.

FIG. 2B illustrates a second preferred connection for connecting adjacent edges of two side panels 22*a* and 22*d*. As in the connection of FIG. 2A, the fabric pieces 30*a* and 30*d* are folded over at their edges at bottom side 26*b* and top side 26*d* to define the respective sleeves 24*a* and 24*d*. However, the frame retaining sleeves 24*a* and 24*d* converge at, or are connected to, one sleeve portion which interconnects side panels 22*a* and 22*d* to form a singular frame retaining sleeve 40 which retains the frame members 28*a* and 28*d*. Sleeve 40 may be formed by providing a tubular fabric, or by folding a piece of fabric, and applying a stitching 42 to its edges to connect the sleeve 40 to the fabric pieces 30*a* and 30*d*. Stitching 42 acts as a hinge for the side panels 22*a* and 22*d*. The connections for the three other pairs of adjacent edges may be identical.

An upper panel (not shown) comprised of fabric may also be connected to the upper edge 26*d* of each side panel 22*a*, 22*b*, 22*c* and 22*d*. Likewise, a lower panel 36 comprised of fabric 30*f* may also be connected to the bottom edge 26*b* of each side panel 22*a*, 22*b*, 22*c* and 22*d*. The upper panel and the lower panel 36 can be made of the same type of fabric as the side panels 22*a*, 22*b*, 22*c* and 22*d*. Each module 20 can have at least the four side panels 22*a*, 22*b*, 22*c* and 22*d*, with the upper and lower panels 32 and 36 being optional.

Amusement features can be provided with the module 20 of FIG. 1. Openings 38 may be provided in one or more of the panels 22*a*, 22*b*, 22*c*, 22*d* and 36. These openings 38 may be of any shape (e.g., triangular, circular, rectangular, square, diamond, etc.) and size and are designed to allow an individual to crawl through them to enter or to exit the module 20. In addition, a netting 32 may be suspended to the inner or outer surface of any of the fabrics 30*a*, 30*b*, 30*c*, 30*d* of one or more of the panels 22*a*, 22*b*, 22*c*, 22*d*. Other amusement features can be provided on any of the panels 22*a*, 22*b*, 22*c*, 22*d*.

While the module 20 of FIG. 1 is shown and described as having four side panels, each having four sides, it will be appreciated that a module may be made of any number of side panels, each having any number of sides, without departing from the spirit and scope of the present invention. For example, each module may have two or more side panels (e.g., see FIG. 26 below), and each side panel may have three or more sides. Thus, the module of the present invention may take a variety of external shapes. However, each side panel of the module, regardless of its shape, is supported by at least one continuous frame member.

Figure 3A:
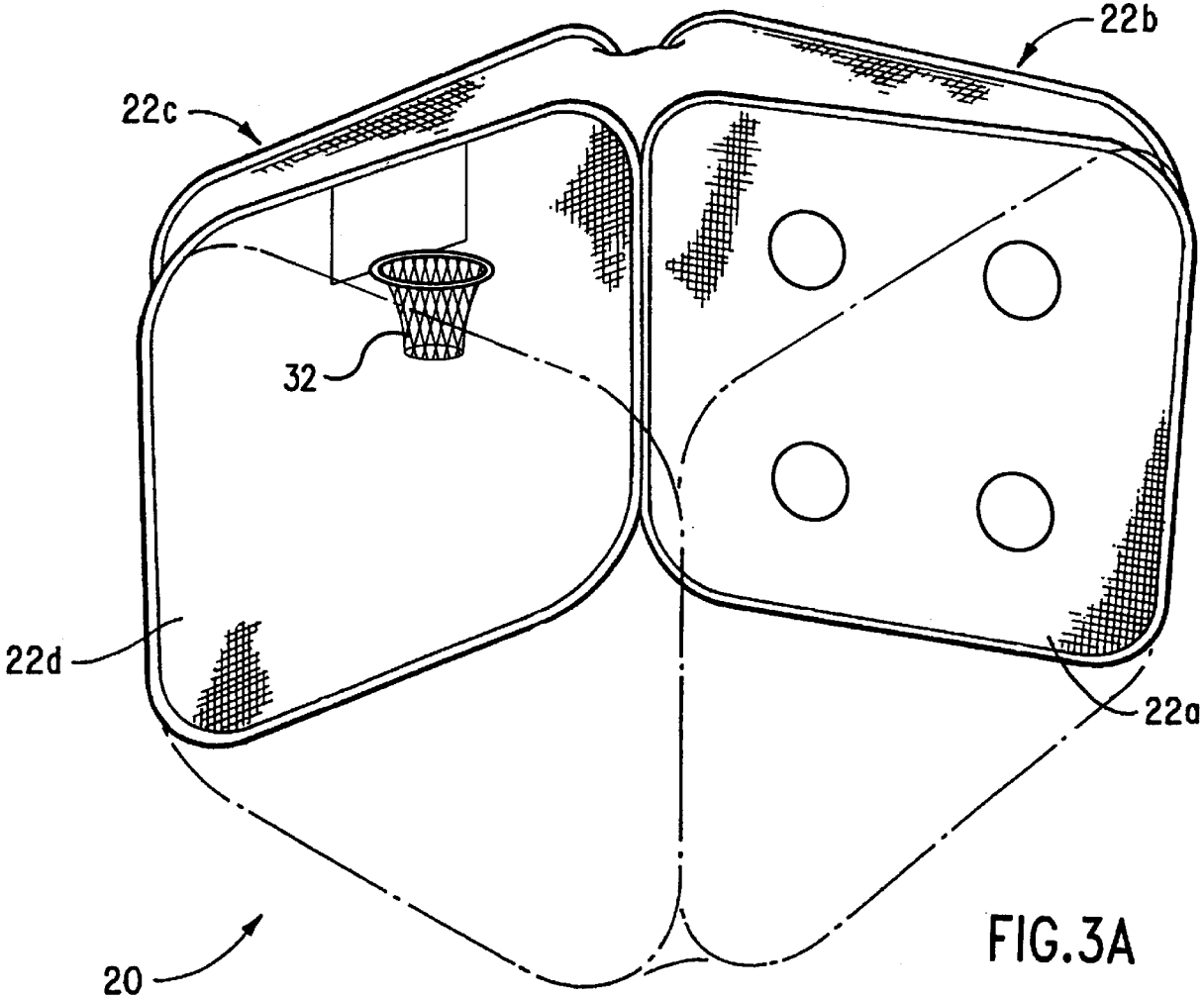
FIGS. 3(A) through 3(E) illustrate how the collapsible structure of FIG. 1 may be twisted and folded for compact storage.
Figure 3B:
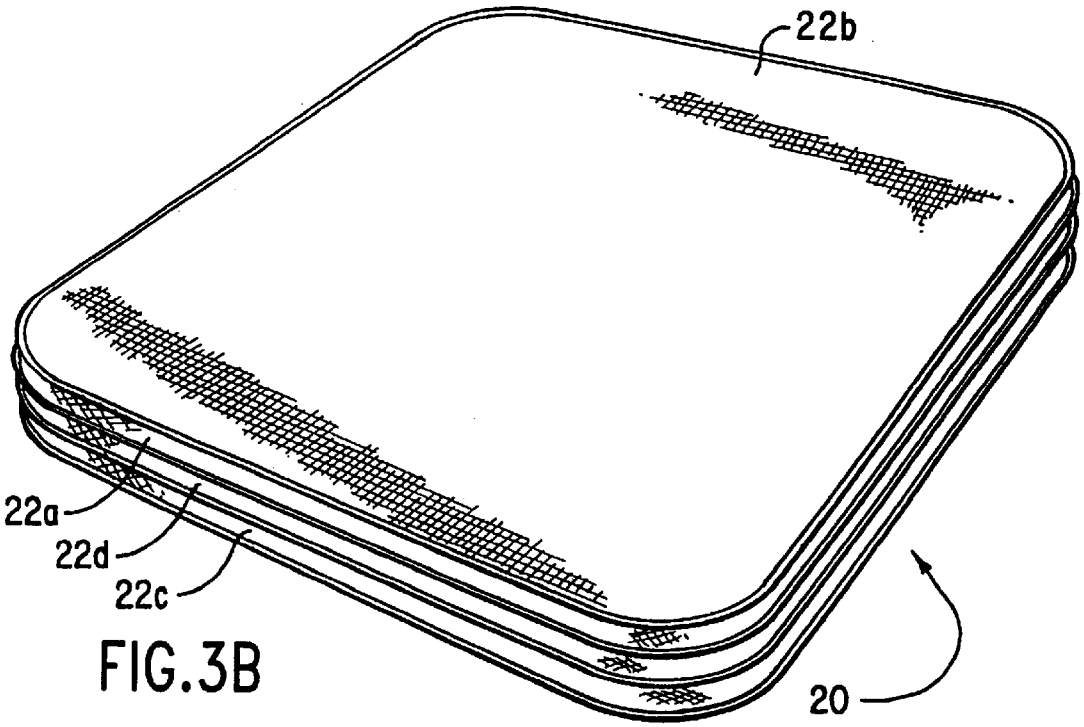
Figure 3C:
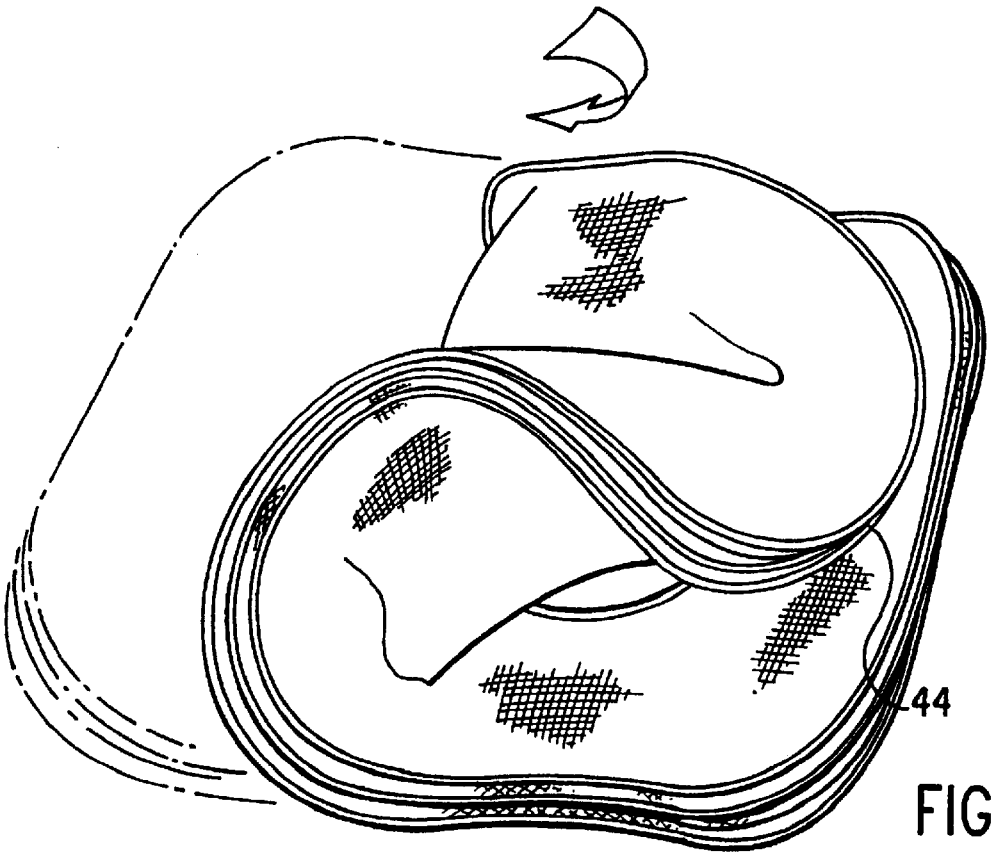
Figure 3D:
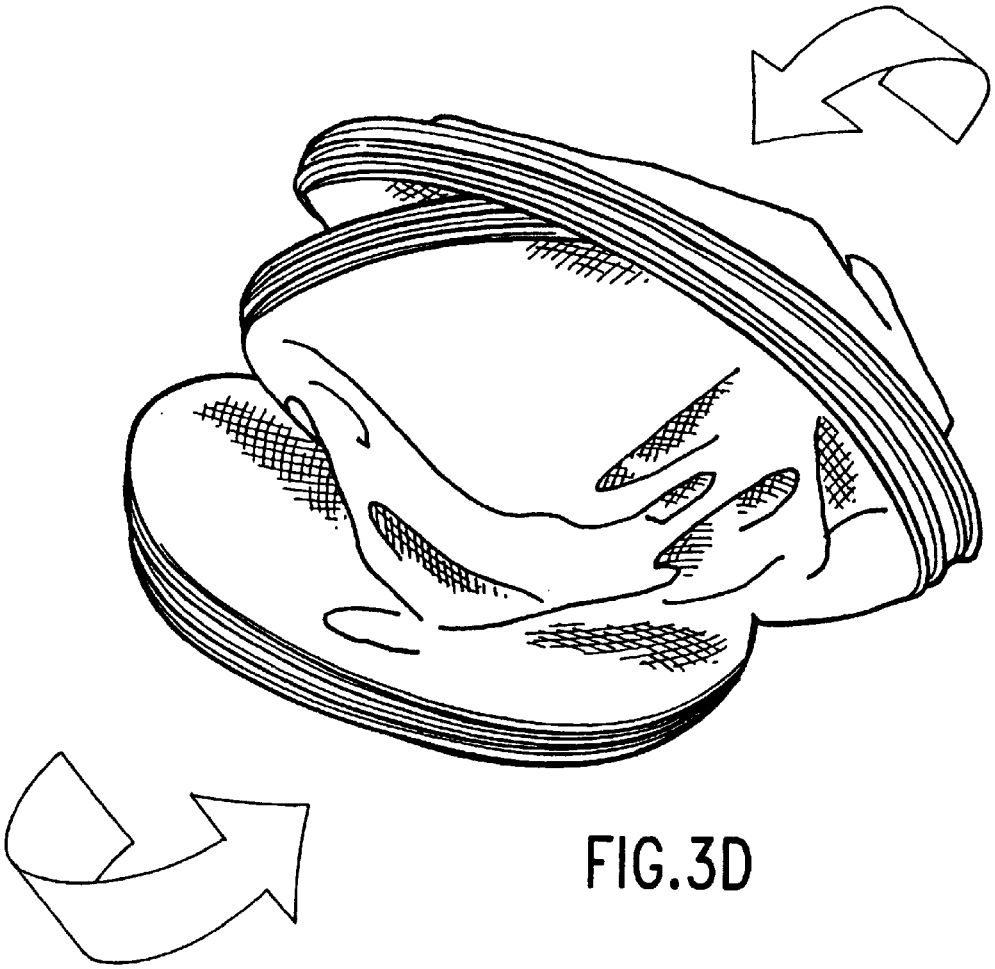
Figure 3E:
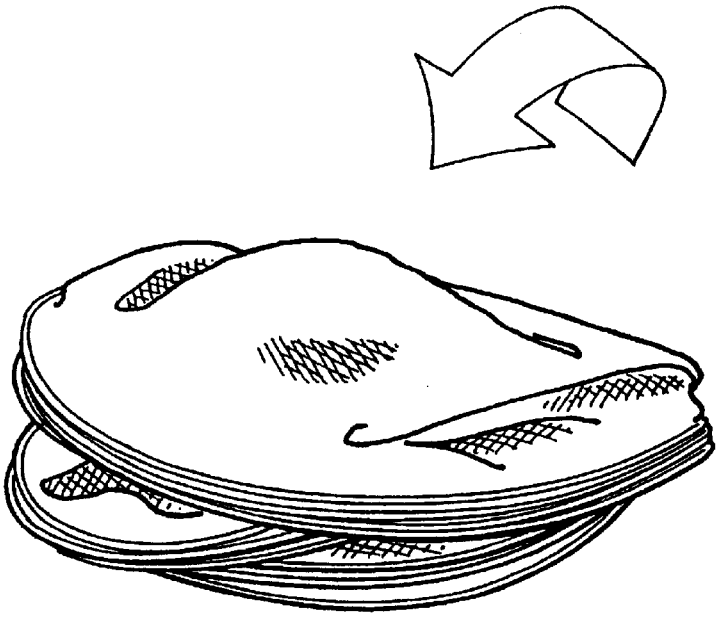

FIGS. 3(A) through 3(E) describe the various steps for folding and collapsing the structure or module 20 of FIG. 1 for storage. In FIG. 3(A), the first step consists of pushing in side panels 22*a* and 22*d* such that side panel 22*d* collapses against side panel 22*c* and side panel 22*a* collapses against side panel 22*b*. Then, in the second step shown in FIG. 3(B), the two side panels 22*a* and 22*b* are folded so as to be collapsed upon the two side panels 22*c* and 22*d*. The structure is then twisted and folded to collapse the frame members and side panels into a smaller shape. In the third step shown in FIG. 3(C), the opposite border 44 of the structure is folded in upon the previous fold to further collapse the frame members with the side panels. As shown in FIG. 3(D), the fourth step is to continue the collapsing so that the initial size of the structure is reduced. FIG. 3(E) shows the fifth step with the frame members and side panels collapsed on each other to provide for a small essentially compact configuration having a plurality of concentric frame members and layers of the side panels so that the collapsed structure has a size which is a fraction of the size of the initial structure.

To re-open the structure 20 to its expanded configuration, the combined stack of side panels is unfolded. The memory (i.e., spring-load) of the frame members will cause the frame members to uncoil on their own and to quickly expand the panels to their expanded configuration shown in FIG. 3B. The same principle can be applied to re-open all the other embodiments of the present invention.

Figure 4:
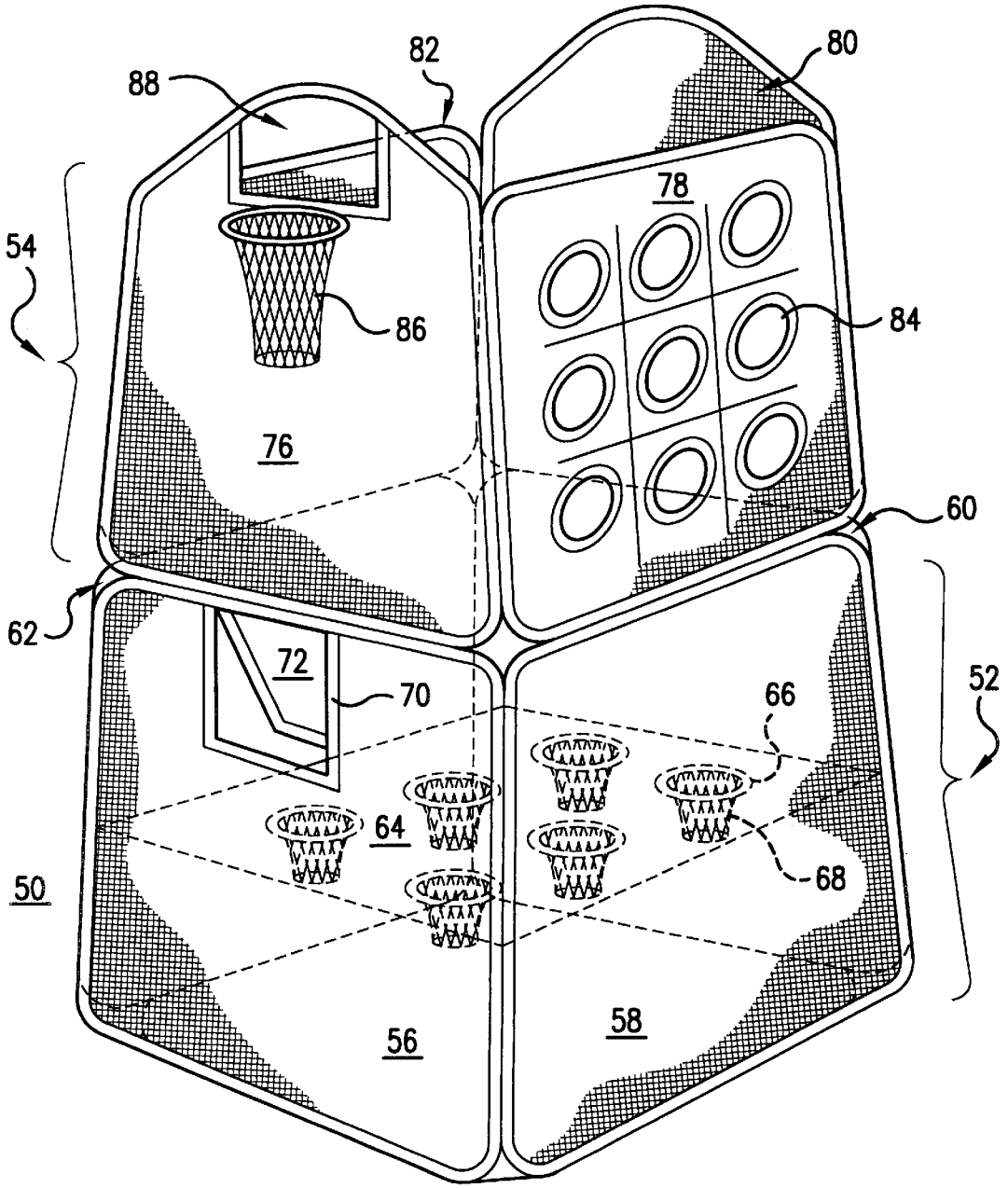
FIG. 4 is a perspective view of a collapsible structure according to another preferred embodiment of the present invention.

Each basic module 20 can be used as a building block and combined with other basic modules 20 to provide structures having different shapes and sizes. For example, a plurality of these basic modules 20 can be stacked vertically. One such example is shown in FIG. 4. The structure 50 has two modules 52 and 54, with a base module 52 and an upper module 54 stacked vertically on top of the base module 52. Each module 52 and 54 has essentially the same construction as module 20, except that the upper and lower fabrics 30*e* and 30*f* have been omitted. In addition, a few enhancements have been added to these modules 52 and 54, as described below.

The base module 52 has four side panels 56, 58, 60, 62 that are hingedly attached together in the same manner as side panels 22*a*, 22*b*, 22*c*, 22*d* of module 20. A horizontal central fabric 64 extends across the internal space of the base module 52 at about the vertical center thereof. A plurality of openings 66 are provided in the central fabric 64, each opening 66 having a net 68 suspended therefrom. One or more openings 70 can also be provided in one of the side panels (such as 56). A flap 72 is hingedly connected along an upper edge, such as by stitching, to an upper edge of the opening 70 to cover the opening 70. Alternatively, the flap 72 can be provided by cutting its three edges from the fabric of the side panel 56, while leaving the upper edge attached to the fabric to act as a hinge for the flap 72.

The upper module 54 has four side panels 76, 78, 80, 82 that are stitched together in the same manner as side panels 22*a*, 22*b*, 22*c*, 22*d* of module 20. A plurality of openings 84 can be provided in one of the side panels (such as 78). In addition, a basket or net 86 can be attached to the outer surface of one of the side panels (such as 76), and an opening 88 can be provided thereabove.

Figure 5:
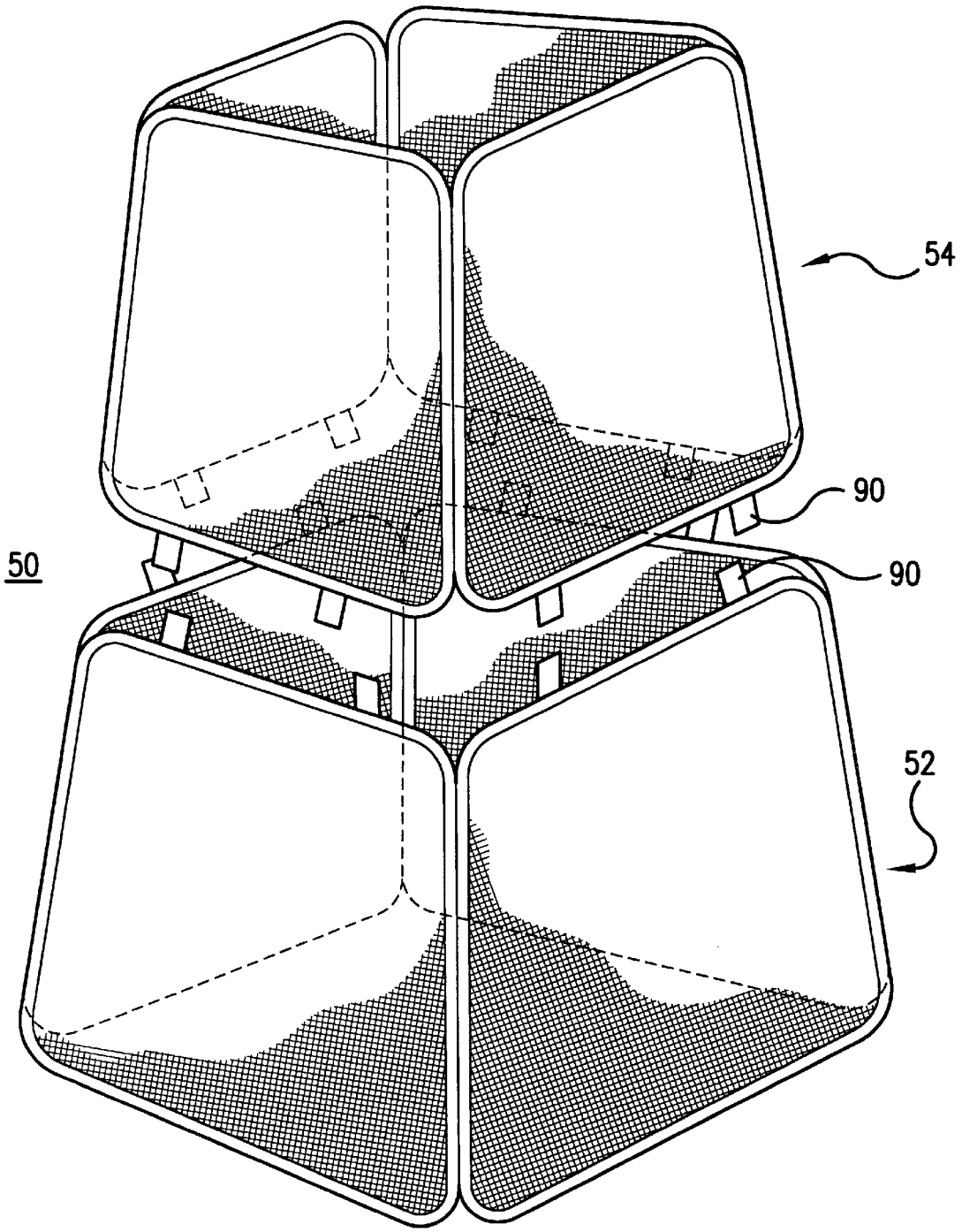
FIG. 5 illustrates a possible modification to the structure of FIG. 4.

The bottom edges of the four side panels 76, 78, 80, 82 are attached to the top edges of the four side panels 56, 58, 60, 62 in a manner that maintains the upper module 54 securely on top of the lower module 52. This attachment can be accomplished by stitching the bottom edges of the four side panels 76, 78, 80, 82 to the top edges of the four side panels 56, 58, 60, 62, as illustrated in FIG. 4, using the attachment method shown in FIGS. 2A or 2B. Alternatively, this attachment can be accomplished by using detachable connectors or attachment mechanisms, such as opposing Velcro pads 90, hooks, ties or similar mechanisms, as shown in FIG. 5. For simplicity, the modules 52, 54 are shown in FIG. 5 in their most generic sense without the enhancements (e.g., without nets 68, 86, openings 70, 84, 88, etc.).

Thus, referring back to FIG. 4, the vertical stacking of modules 52, 54 provides a tower-like game structure 50 that offers a variety of play features. For example, the user can toss a ball or object through the net 86, or through openings 70, 84 or 88. In addition, the user can attempt to toss a ball or object through one of the openings 66 (and into nets 68) in the central fabric 64 via the open top of the structure 50, or via one of the other openings 70, 84 or 88. The use of two side panels (such as 56 and 76) to create an increased height for one side of the structure 50 allows the structure 50 to be provided with a height that is greater than where just one side panel is used to define one side of the structure. In contrast, merely providing one elongated side panel to span a greater height for the structure may result in the structure having less stability, since the one coilable frame member that supports the one side panel may not be strong enough to provide a stable vertical support at certain heights.

Figure 6A:
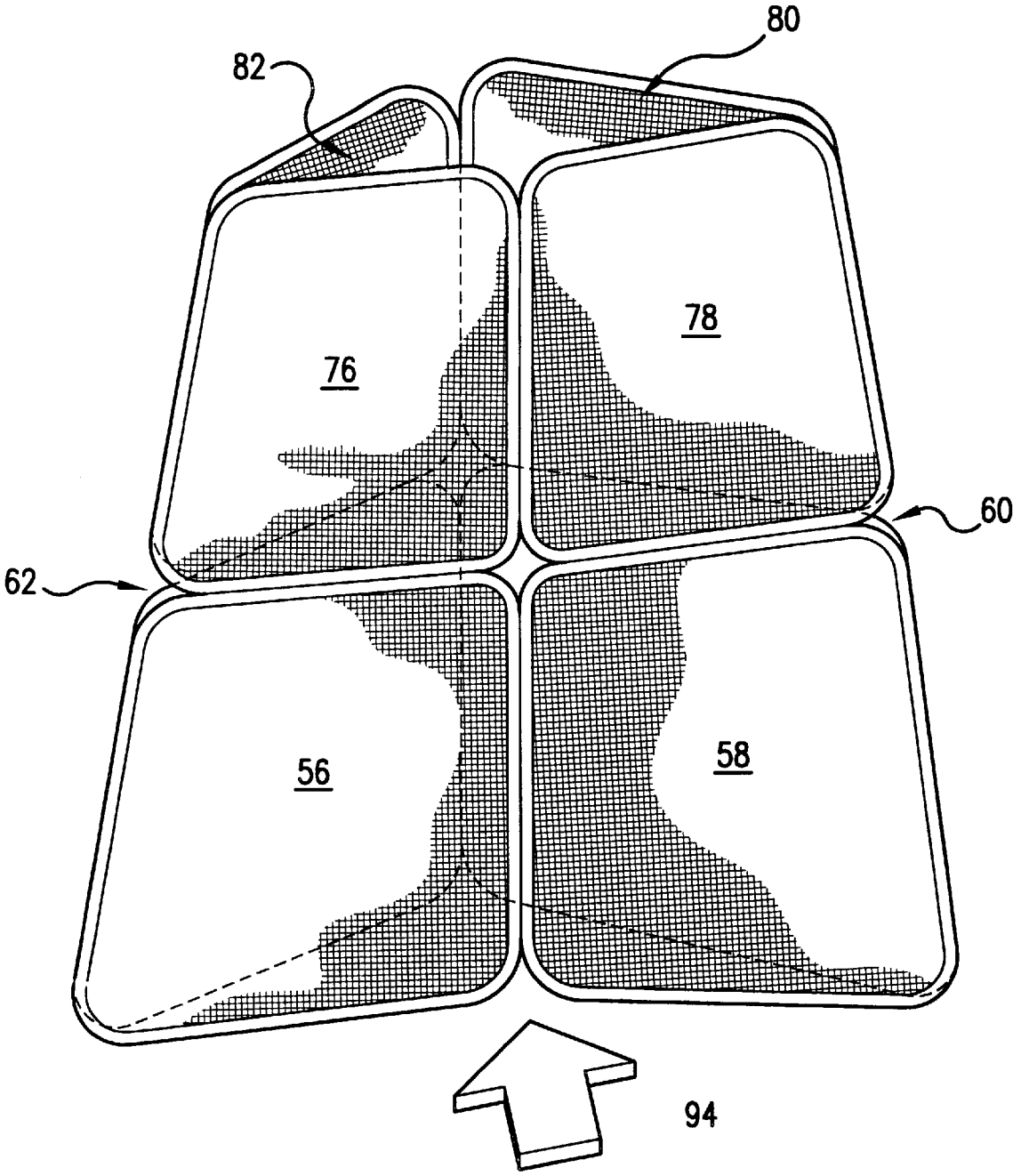
FIGS. 6A–6D illustrate how the collapsible structure of FIGS. 4 and 5 may be twisted and folded for compact storage.
Figure 6B:
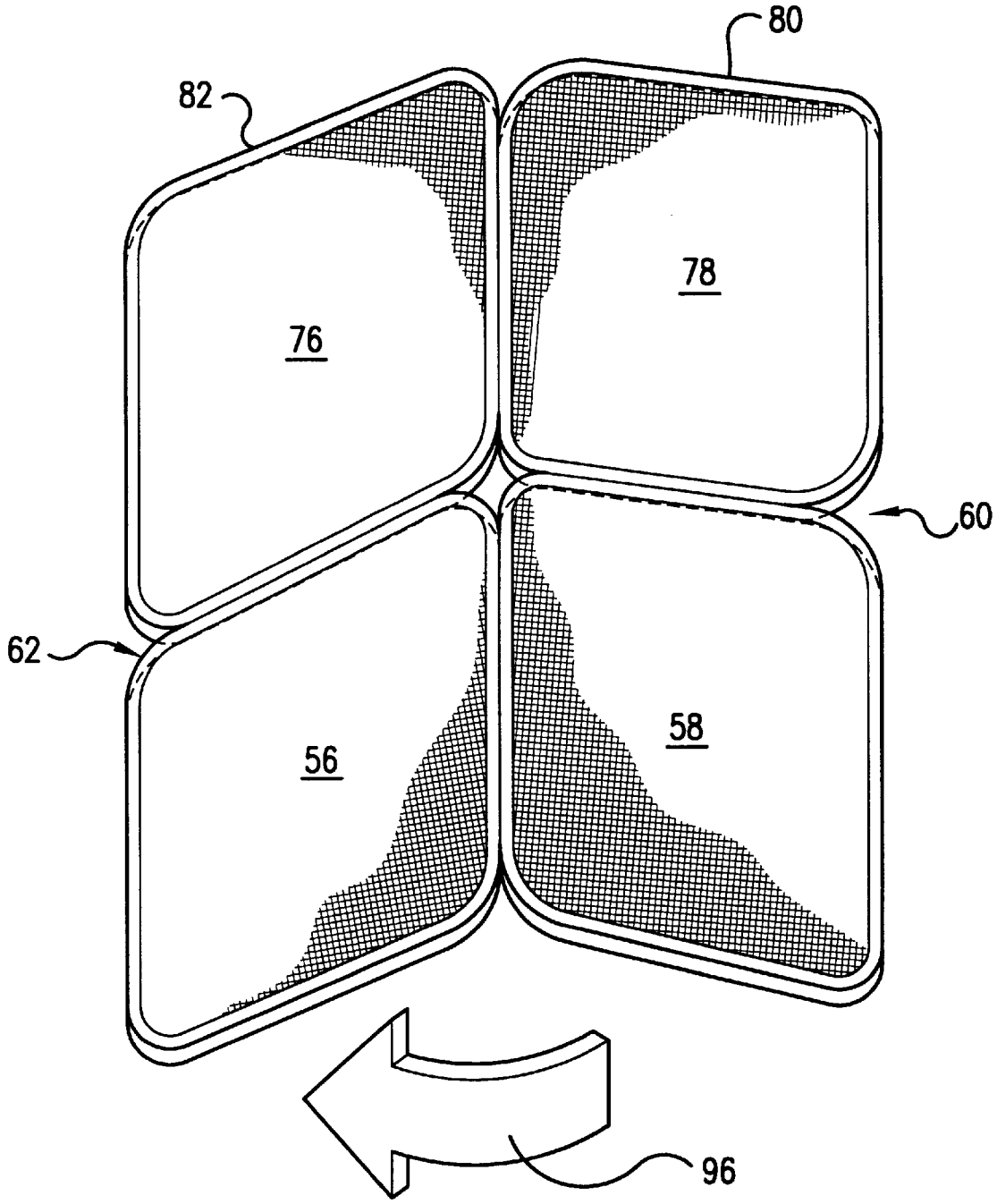
Figure 6D:
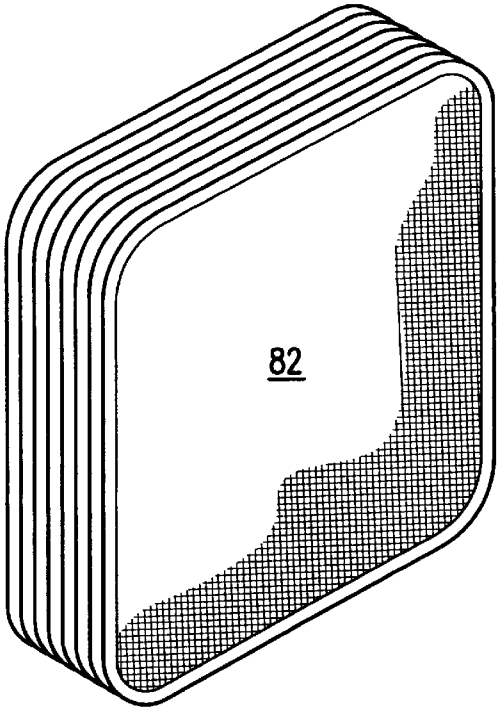
Figure 6C:
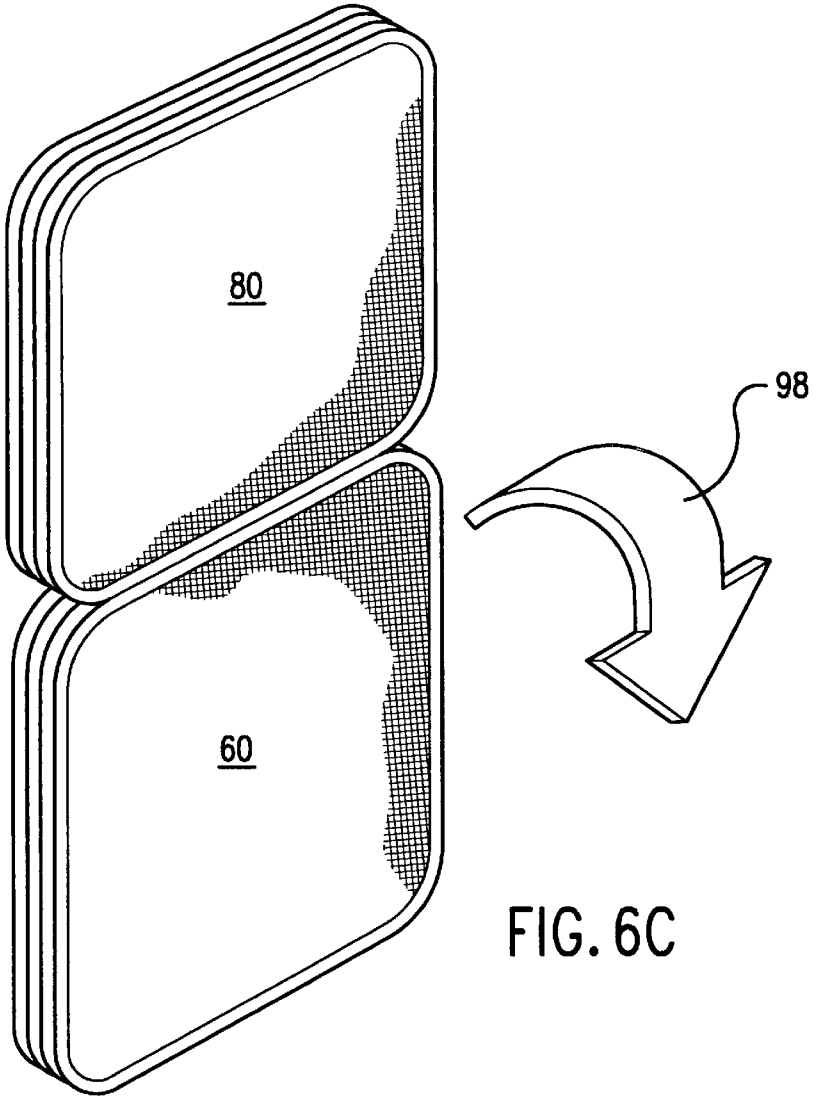

It is also very easy to fold and collapse the structure 50. FIGS. 6A–6D illustrate the modules 52, 54 in their most generic sense without the enhancements (e.g., without nets 68, 86, openings 70, 84, 88, etc.) to simplify the illustration. Referring to FIG. 6A, two horizontally adjacent side panels of each module and their corresponding vertically adjacent side panels from the other module (e.g., panels 56, 58 of module 52 and panels 76, 78 of module 54) are pushed onto the other panels (such as panels 62, 60 of module 52 and panels 82, 80 of module 54, respectively), about their respective hinged connections, in the direction of arrow 94. This will create a stack of four panels having two vertical rows of panels, with panels 56, 58, 76, 78 on one level of the stack, and panels 62, 60, 82, 80 on the other level of the stack, as shown in FIG. 6B. Then, as shown in FIG. 6B, one vertical row of combined panels (e.g., 58, 78, 60, 80) is folded about their hinged connections in the direction of arrow 96 to be collapsed upon the other vertical row of combined panels (e.g., 56, 76, 62, 82). This will create a stack of one vertical row of panels, with panels 60, 80 on one level of the stack, panels 58, 78 on the second level of the stack, panels 56, 76 on the third level of the stack, and panels 62, 82 on the fourth level of the stack as shown in FIG. 6C. Finally, the one vertical row of panels is folded about its hinged connections at the center thereof (see direction of arrow 98) to create one singular stack of panels in this order (viewed from the front of FIG. 6D): 82, 76, 78, 80, 60, 58, 56, 62. The combined stack of eight panels may then be twisted and folded in the manner described above in connection with FIGS. 3(C)–3(E).

The steps illustrated in FIG. 6A–6D can be applied to the structure 50 illustrated in either FIG. 4 or FIG. 5, regardless of whether stitching or detachable connectors are used to attach the upper module 54 to the base module 52. To re-open the structure 50 to its expanded configuration, the combined stack of panels 82, 76, 78, 80, 60, 58, 56, 62 is unfolded. The memory (i.e., spring-load) of the frame members will cause the frame members to uncoil on their own and to quickly expand the panels to their expanded configuration shown in FIG. 6D. For this reason, all the structures illustrated herein can be re-opened in the same way. At this point, the steps shown in FIGS. 6A–6C can then be reversed to deploy the structure 50 to the configuration shown in FIG. 4.

In addition, the modules 52, 54 in FIG. 5 can be separated, and each module 52, 54 folded and collapsed separately in the manner described above in connection with FIGS. 3(A)–3(E). By allowing the modules 52, 54 to be separated, the user derives additional variety in use and play, since each of the modules 52, 54 can itself be a stand-alone structure or game.

Although the side panels of the modules 52, 54 have been illustrated as being attached and possibly detached in the two ways shown in FIGS. 4 and 5, the side panels can also be attached and possibly detached in a number of other ways, as illustrated in FIGS. 7–17 below.

Figure 7:
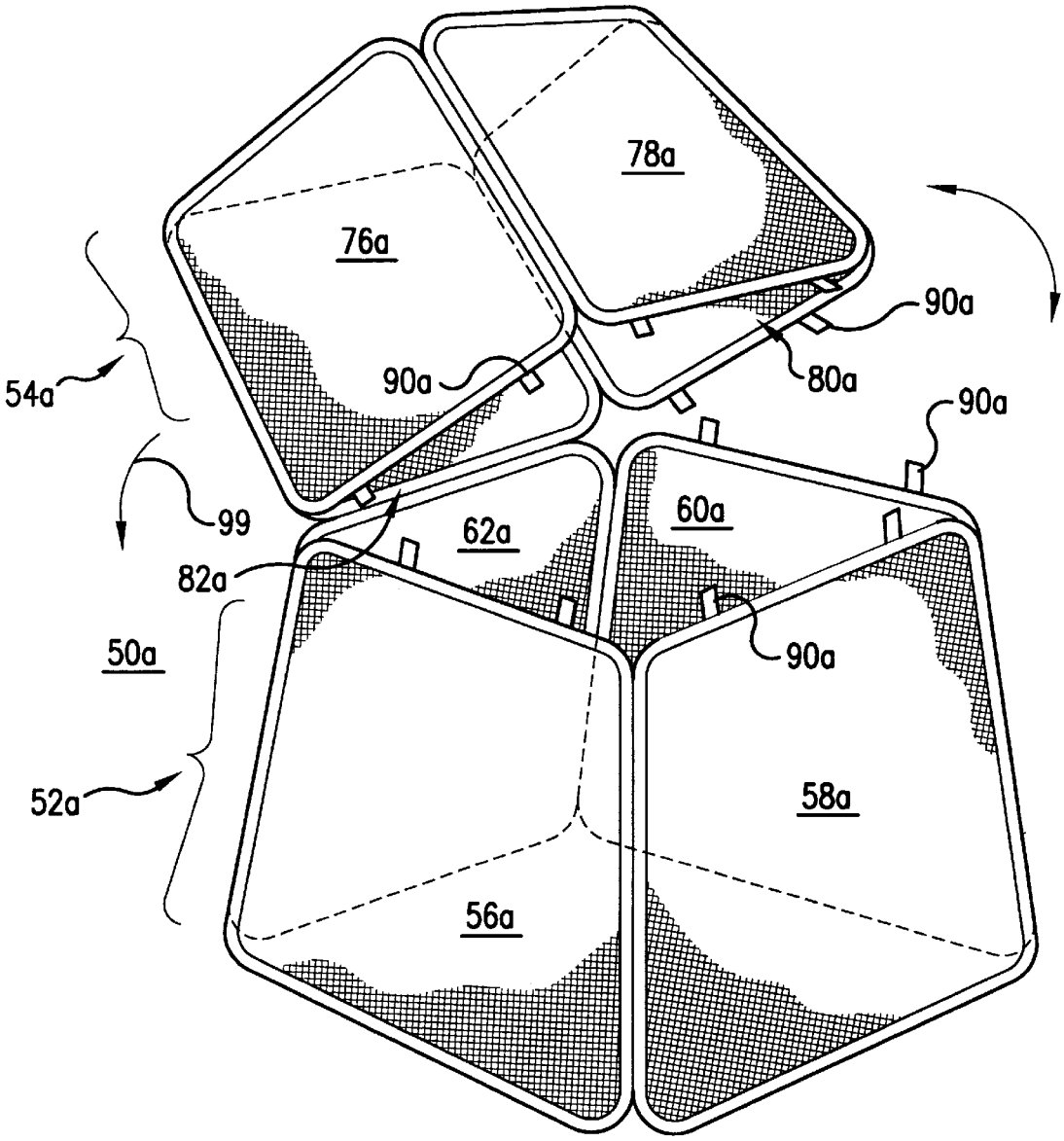
FIGS. 7–17 are perspective views of collapsible structures that incorporate various modifications to and variations of the basic structure illustrated in FIGS. 4 and 5.

FIG. 7 illustrates a structure 50*a* that includes modifications to the structure 50. The elements of the structure 50*a* that are the same as the elements of the structure 50 are provided with the same numeral designations except that an "a" has been added to the numeral designations in FIG. 7. Again, the modules in FIG. 7 (and in FIGS. 8–27 below) are illustrated in their most generic sense without any possible enhancements (e.g., without nets 68, 86, openings 70, 84, 88, etc.). The structure 50*a* combines the principles of FIGS. 4 and 5 in that the bottom edge of side panel 82*a* is stitched to the top edge of side panel 62*a* by using, for example, the attachment method shown in FIGS. 2A or 2B, while the bottom edges of the other side panels 76*a*, 78*a*, 80*a* of module 54*a* are attached to the top edges of the other side panels 56*a*, 58*a*, 60*a* of module 52*a* using opposing sets of detachable connectors 90*a*. Therefore, the module 54*a* can be folded about the hinged connection between the bottom edge of panel 82*a* and the top edge of panel 62*a* in the direction of arrow 99 and rested on a surface so that both modules 52*a*, 54*a* are positioned side-by-side in their expanded configurations. When so positioned, the two modules 52*a*, 54*a* can be used as table legs for supporting a table top.

Thus, the structure 50*a* can be folded and collapsed in a variety of different ways. For example, the steps illustrated in FIGS. 6A–6D can be used to fold and collapse the structure 50*a*.

As another example, the detachable connectors 90*a* adjacent the bottom edges of the panels 76*a*, 78*a*, 80*a* of module 54*a* and the top edges of the other panels 56*a*, 58*a*, 60*a* of module 52*a* can be detached, as shown in FIG. 7, and the panels 76*a*, 78*a* folded against panels 82*a*, 80*a*, respectively, and then the panels 56*a*, 58*a* folded against panels 62*a*, 60*a*, respectively. Thereafter, the combined panels 78*a*, 80*a* can be folded against the combined panels 76*a*, 82*a*, and the combined panels 58*a*, 60*a* can be folded against the combined panels 56*a*, 62*a*. Finally, the combined panels 80*a*, 78*a*, 76*a*, 82*a* of the upper module 54*a* can be folded about the hinged connection between the bottom edge of side panel 82*a* and the top edge of side panel 62*a* in the direction of arrow 99 to form a singular stack of panels in this order (viewed from the front of FIG. 7): 60*a*, 58*a*, 56*a*, 62*a*, 82*a*, 76*a*, 78*a*, 80*a*. The combined stack of eight panels can then be twisted and folded in the manner described above in connection with FIGS. 3(C)–3(E).

Figure 8:
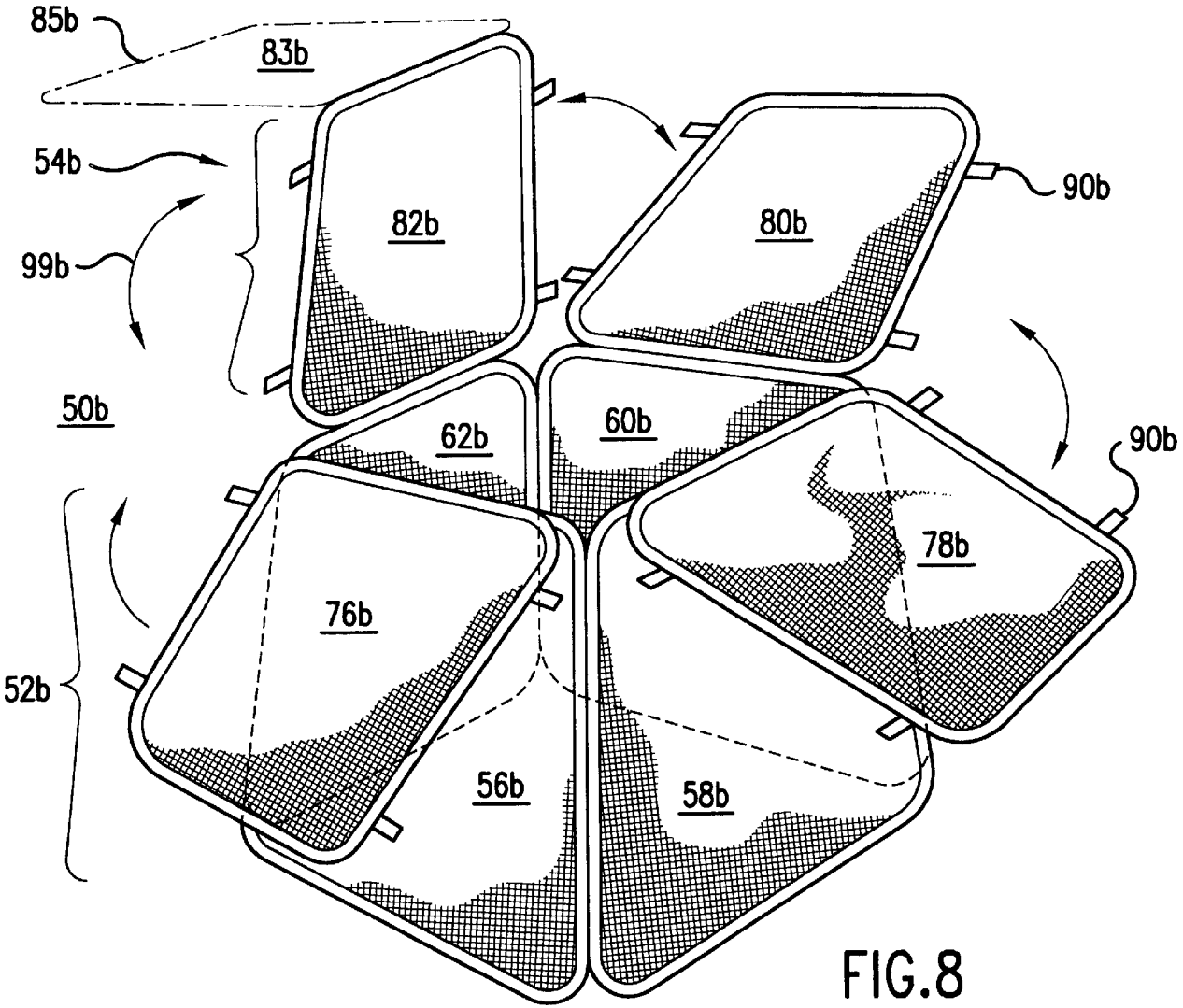

FIG. 8 illustrates a structure 50*b* that includes different modifications to the structure 50. The elements of the structure 50*b* that are the same as the elements of the structure 50 are provided with the same numeral designations except that a "b" has been added to the numeral designations in FIG. 8. In the structure 50*b*, the bottom edge of all the side panels 76*b*, 78*b*, 80*b*, 82*b* of the upper module 54*b* is stitched to the top edge of all the side panels 56*b*, 58*b*, 60*b*, 62*b* of the module 52*b* by using, for example, the attachment method shown in FIGS. 2A or 2B. In contrast, the side edges of the side panels 76*b*, 78*b*, 80*b*, 82*b* of the upper module 54*b* are not stitched to each other, but are each provided instead with opposing sets of detachable connectors 90*b* that can be used to detachably attach each side edge to an adjacent side edge of an adjacent side panel. The configuration of the structure 50*b* allows for selected panels 76*b*, 78*b*, 80*b*, 82*b* of the upper module 54*b* to be raised vertically (e.g., see side panel 82*b*) and for others to be positioned against the corresponding panels of the lower module 52*b*.

As with the structure 50*a*, the structure 50*b* can be folded and collapsed in a variety of different ways. For example, the steps illustrated in FIGS. 6A–6D can be used to fold and collapse the structure 50*b*, with the detachable connectors 90*b* either attached or detached.

As another example, the detachable connectors 90*b* adjacent the side edges of the panels 76*b*, 78*b*, 80*b*, 82*b* of module 54*b* can be detached, as shown in FIG. 8, and each panel 76*b*, 78*b*, 80*b*, 82*b* of the upper module 54*b* folded about its hinged connection against the corresponding panel 56*b*, 58*b*, 60*b*, 62*b* of the base module 52*b*. Thereafter, the combined panels 56*b*, 76*b* and 58*b*, 78*b* can be pushed or folded against the combined side panels 62*b*, 82*b* and 60*b*, 80*b*, respectively, to create two separate stacks of four panels each. Finally, one stack of combined panels 78*b*, 58*b*, 60*b*, 80*b* (in that order) can be folded about their hinged connections against the other stack of combined panels 76*b*,

56*b*, 62*b*, 82*b* (in that order) to form one singular stack of eight panels in this order (viewed from the front of FIG. 8): 80*b*, 60*b*, 58*b*, 78*b*, 76*b*, 56*b*, 62*b*, 82*b*. The combined stack of eight panels may then be twisted and folded in the manner described above in connection with FIGS. 3(C)–3(E).

Referring back to FIG. 8, an additional panel 83*b* (shown in phantom) can be stitched or detachably connected to the top edge of panel 82*b*, so that when the panel 82*b* is detached from its adjacent panels 76*b* and 80*b*, the panel 82*b* can be folded about the hinged connection between its bottom edge and the top edge of panel 62*b* in the direction of arrow 99*b*, and the top edge 85*b* of panel 83*b* can rest against the surface with the panel 83*b* oriented vertically. Thus, panel 82*b* can act as a table top with panels 62*b* and 83*b* acting as support legs.

Figure 8A:
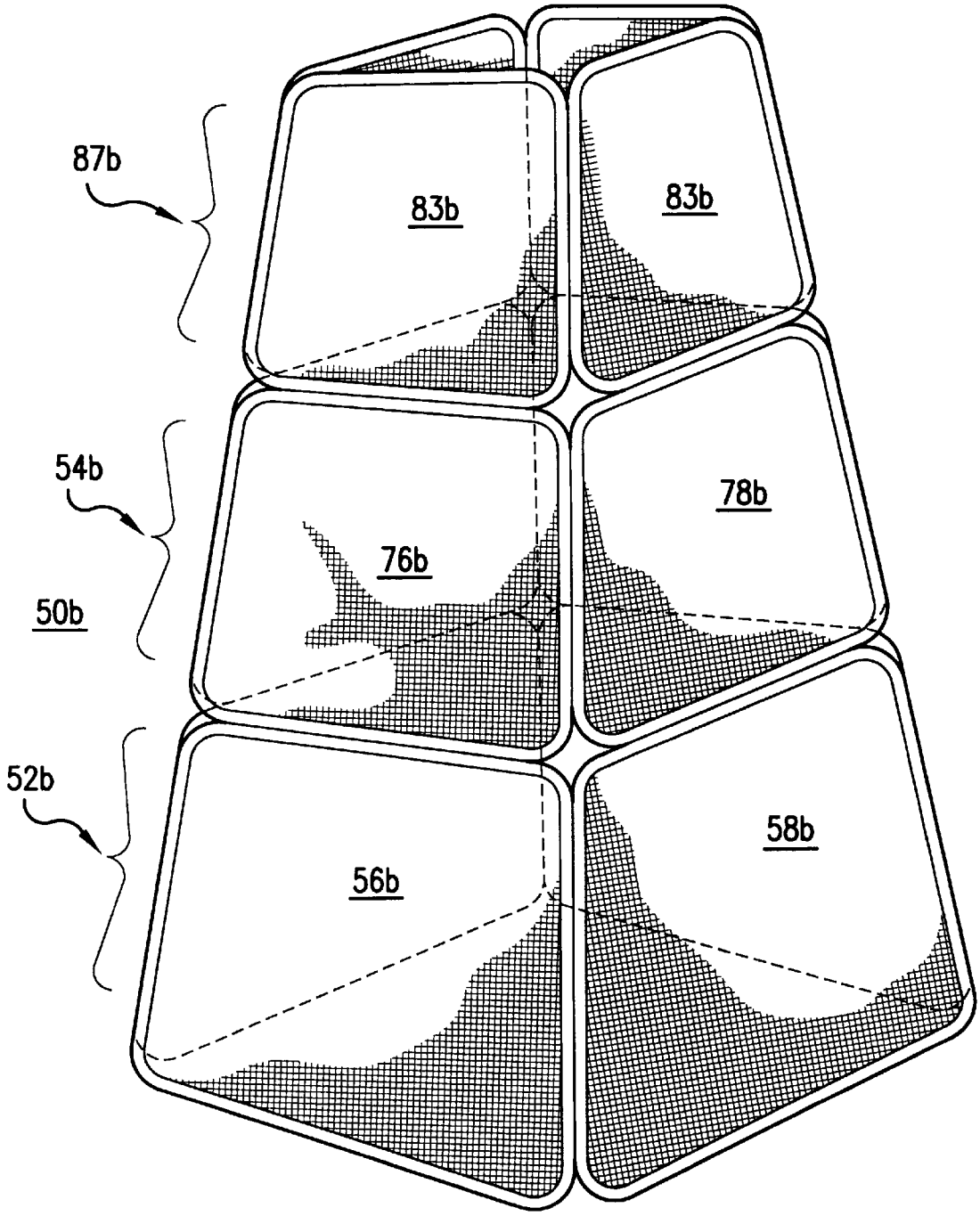

In fact, panels similar to panel 83*b* can be can be stitched or detachably connected to the top edge of the other panels 76*b*, 78*b* and 80*b* of the module 54*b* so that these additional panels 83*b* can form a third module 87*b*, as shown in FIG. 8A. The side edges of the top panels 83*b* can each have opposing detachable attachments. The structure 50 shown in FIG. 8A can be used as a tower-like structure having three levels of side panels, or each vertical row of panels can be detached in the manner illustrated in FIG. 8 and the top edges 85*b* of all the top panels 83*b* rested on a surface to form a cross(+) shaped table.

Figure 9:
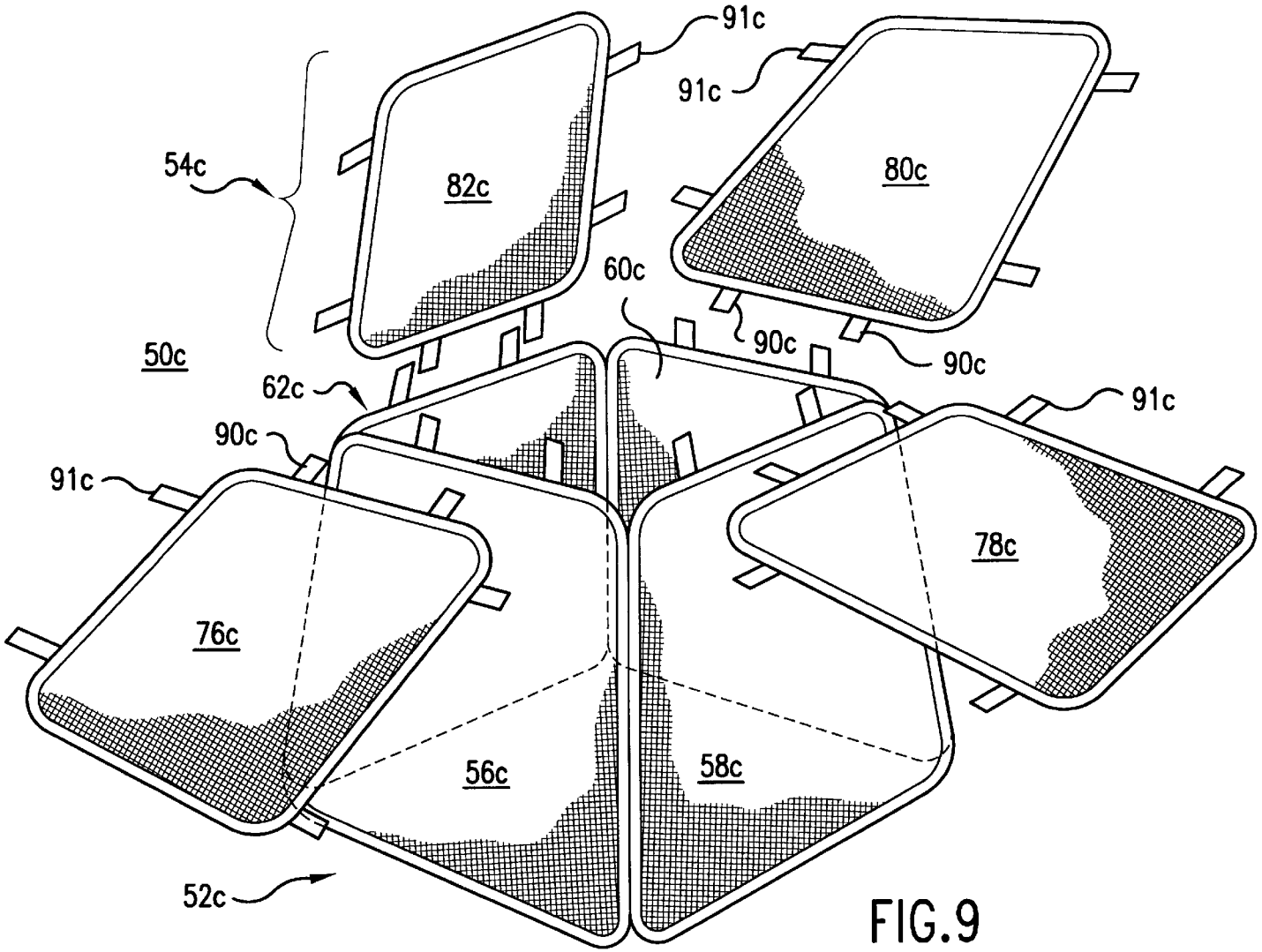

FIG. 9 illustrates a structure 50*c* that combines the principles illustrated in FIGS. 5 and 8. The elements of the structure 50*c* that are the same as the elements of the structures 50 and 50*b* are provided with the same numeral designations except that a "c" has been added to the numeral designations in FIG. 9. In FIG. 9, all the side panels 76*c*, 78*c*, 80*c*, 82*c* of the upper module 54*c* are provided as separate side panels. Opposing sets of first detachable connectors 90*c* can be used to connect the bottom edge of each side panel 76*c*, 78*c*, 80*c*, 82*c* of the upper module 54*c* to the top edge of the corresponding the side panel 56*c*, 58*c*, 60*c*, 62*c* of the lower module 52*c*, and opposing sets of second detachable connectors 91*c* can be used to detachably attach each side edge of each side panel 76*c*, 78*c*, 80*c*, 82*c* of the upper module 54*c* to an adjacent side edge of an adjacent side panel.

Figure 9A:
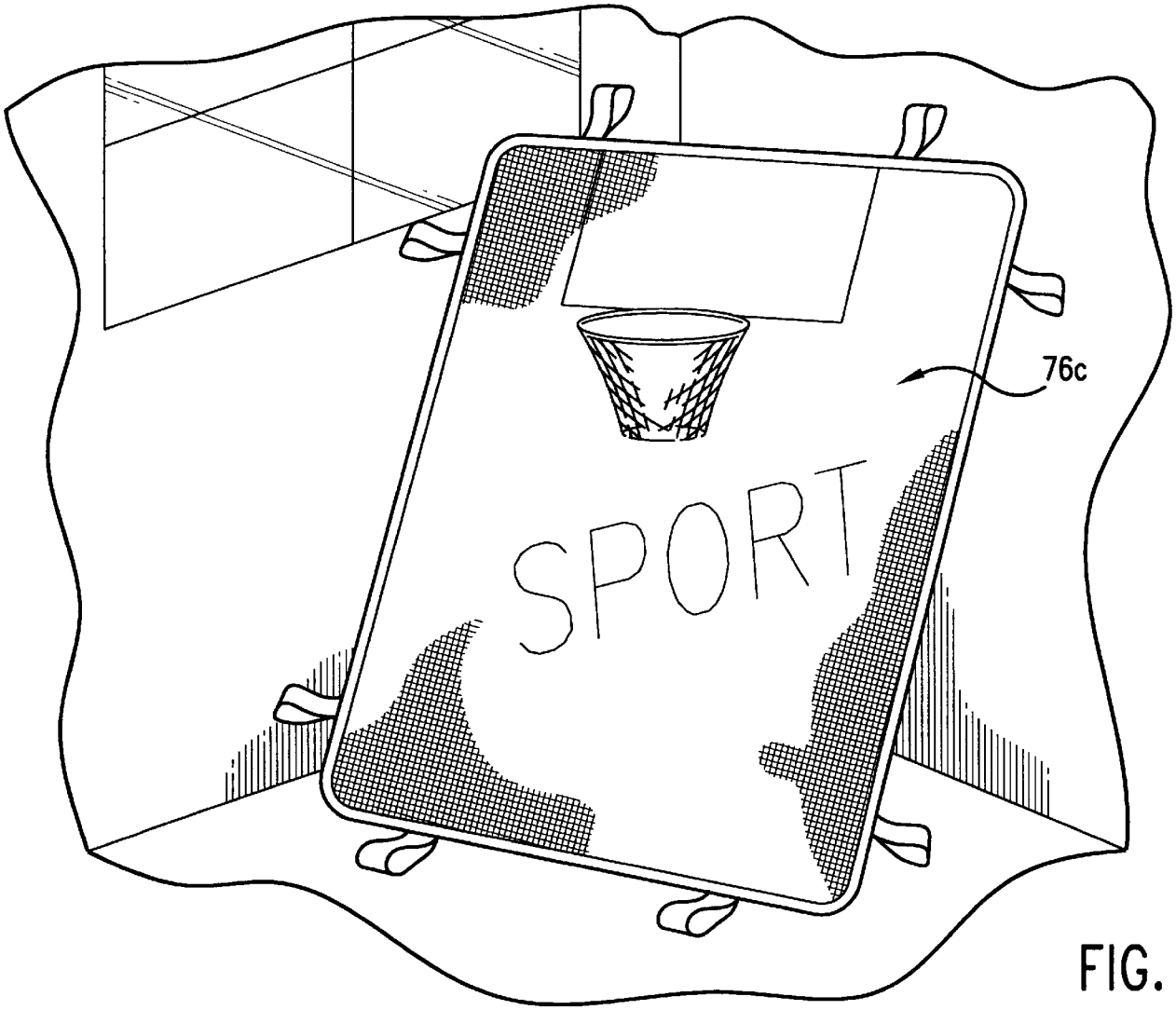
Figure 9B:
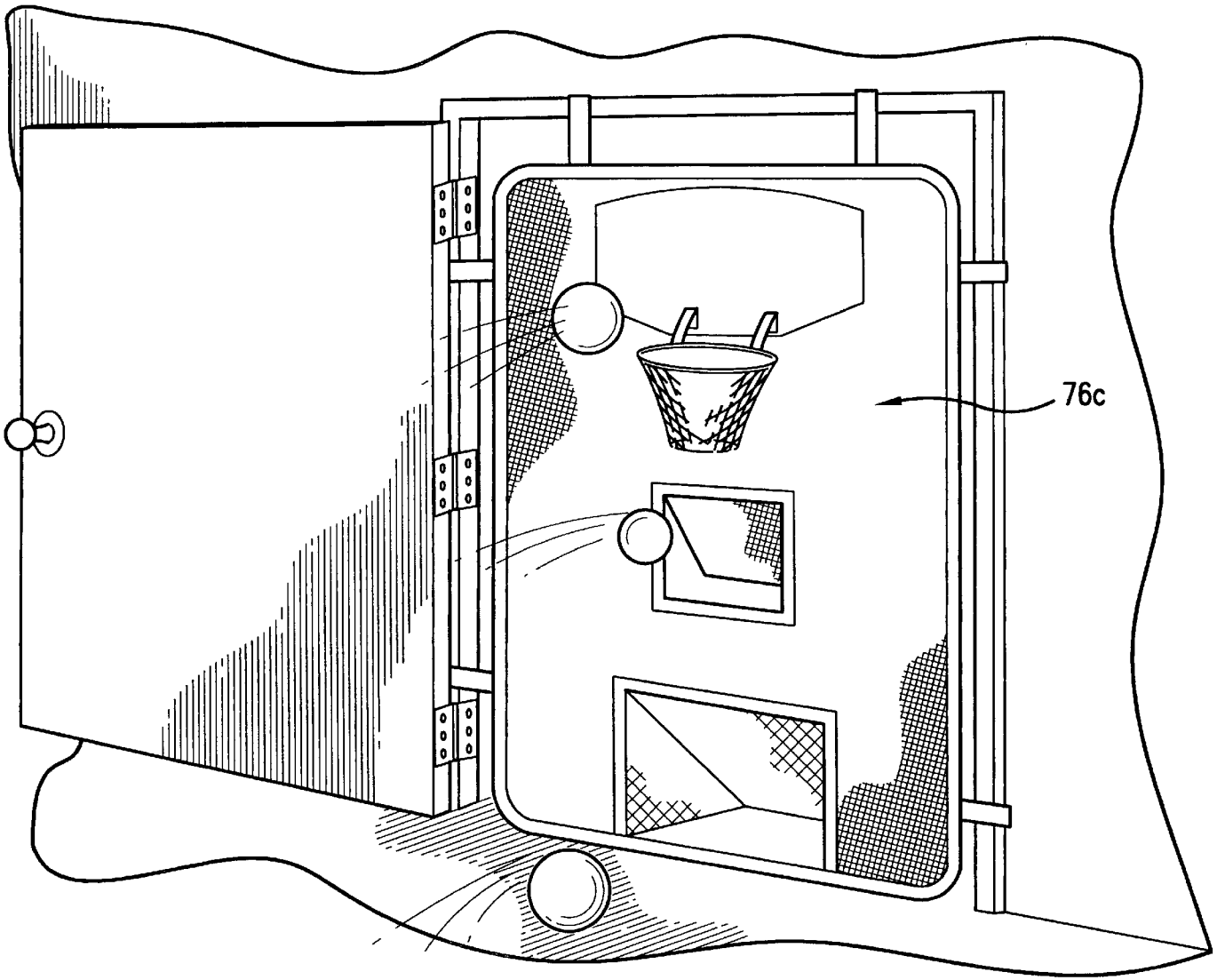
Figure 9C:
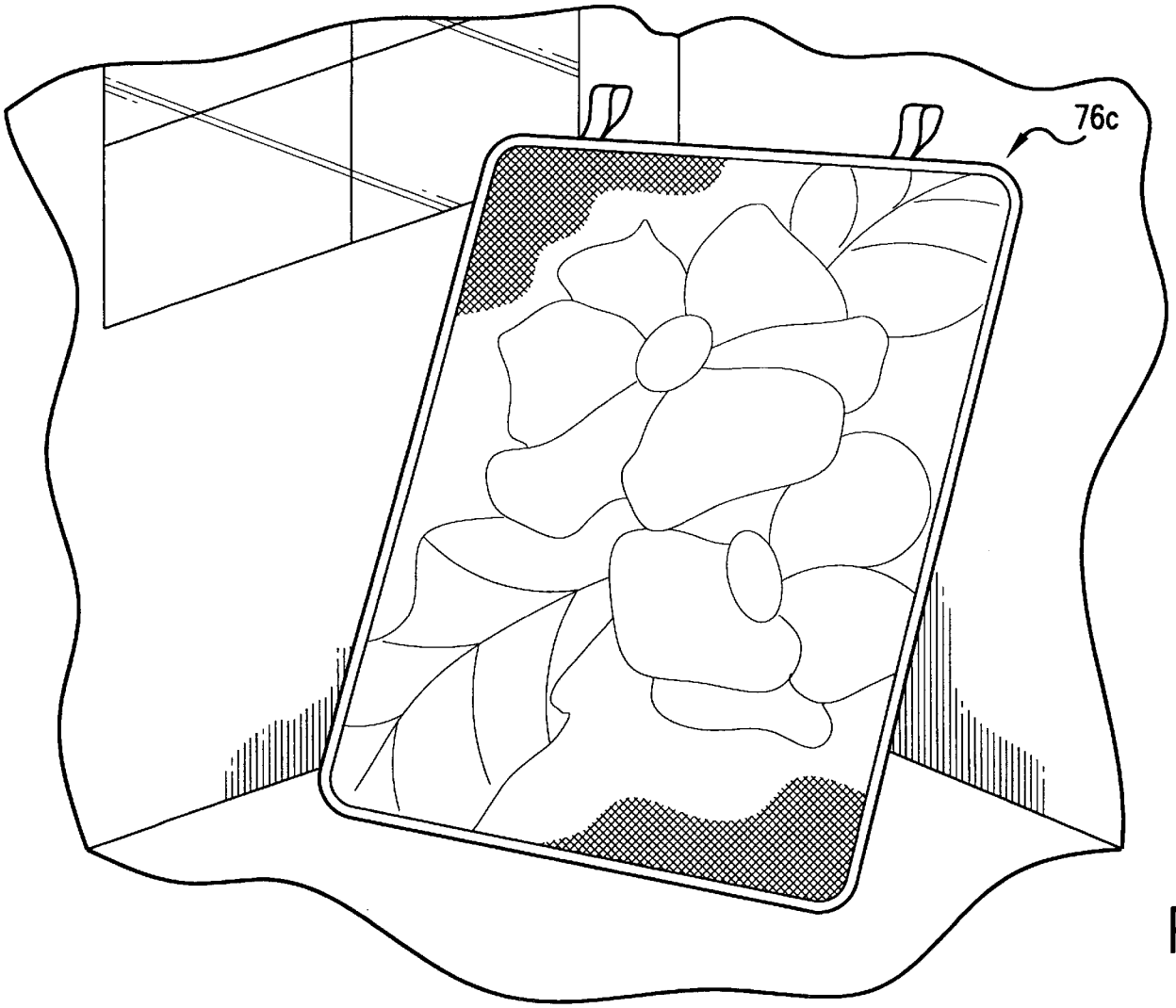
Figure 9D:
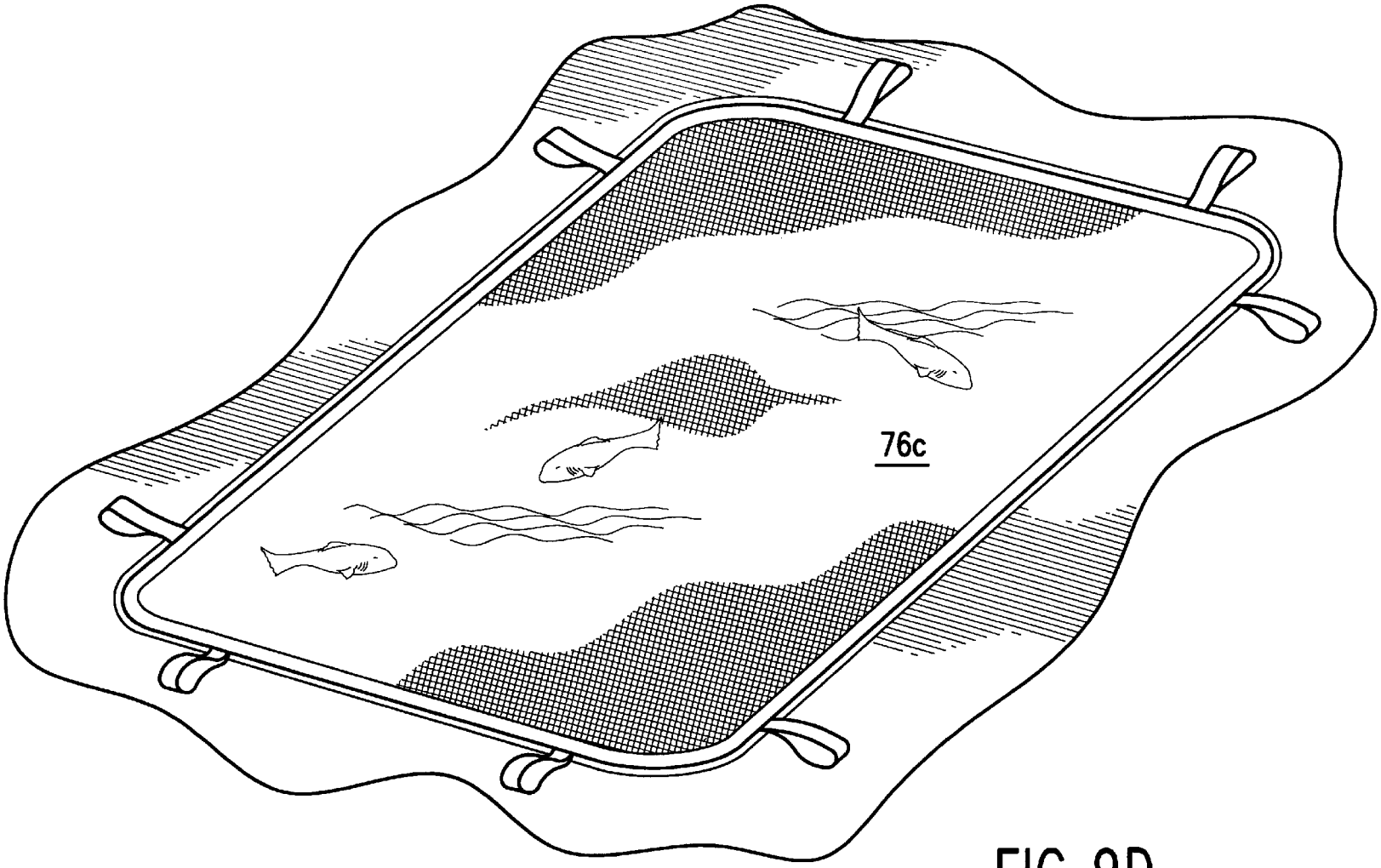
Figure 9E:
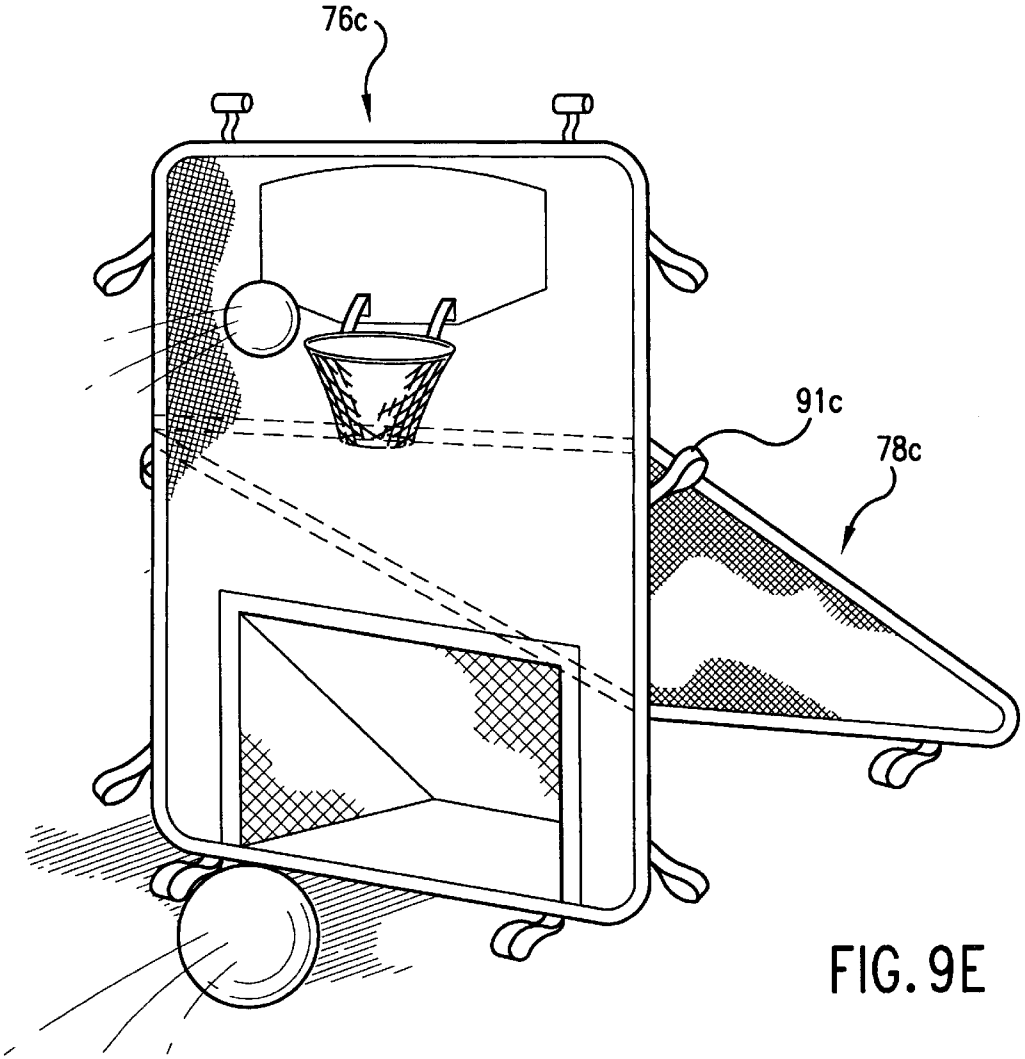
Figure 9F:
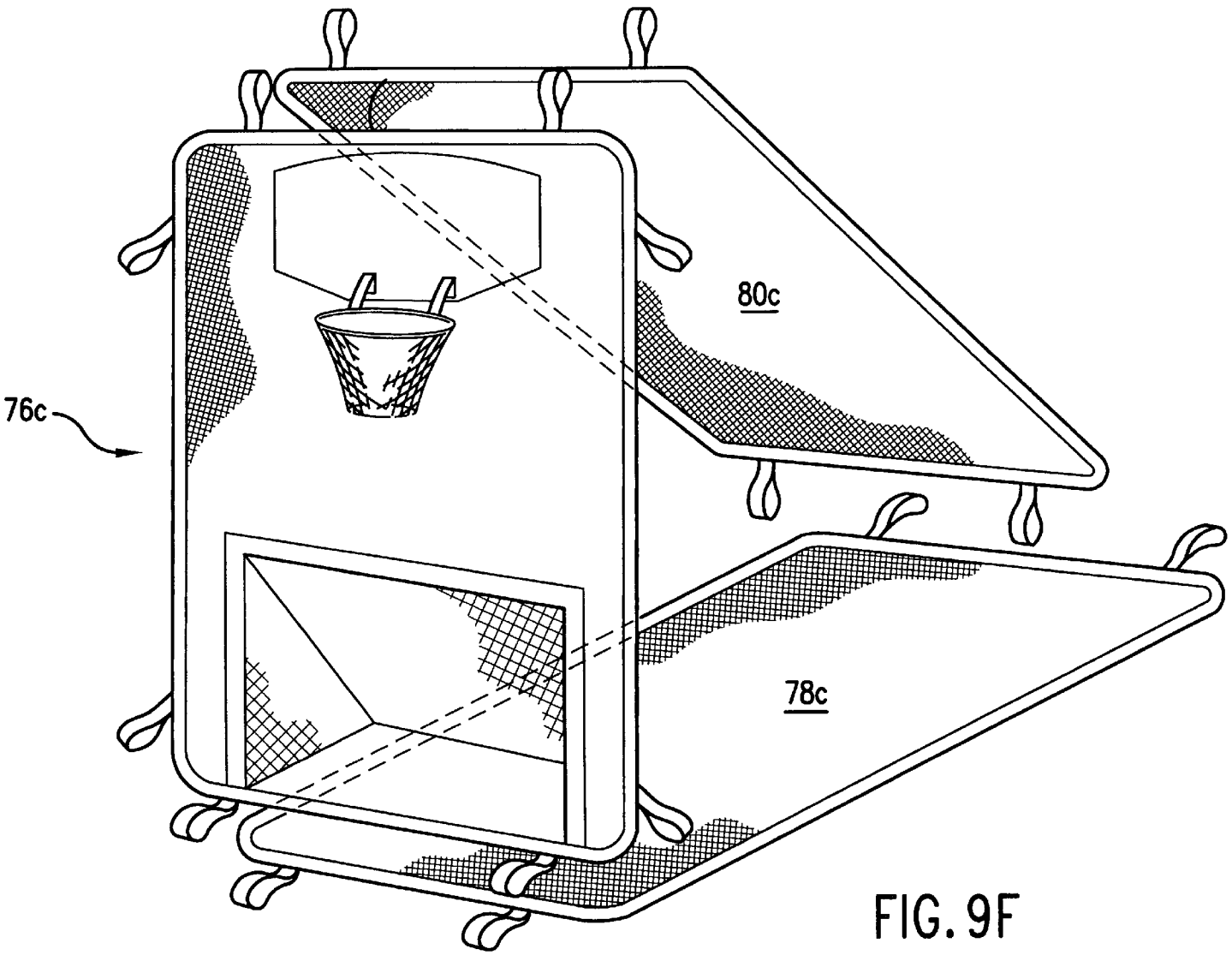

The configuration of the structure 50*c* offers great flexibility and variety in play and use. For example, the user can choose to completely remove all the side panels of the upper module 54*c* and only use the lower module 52*c*. Or, selected side panels of the upper module 54*c* can be raised vertically and other side panels of the upper module 54*c* can be positioned against the corresponding side panels of the lower module 52*c* (or even removed). In addition, each separate side panel of the upper module 54*c* can be used for other purposes. For example, the panel 76*c* can be used, among others, as (1) a backboard (see FIGS. 9A and 9B) or a decorative panel (see FIG. 9C) rested against a wall or other support, (2) a lid or cover for a box, (3) a pool or pond cover (see FIG. 9D), and (4) a floor mat that can be placed on the front entrance of a door, or a floor mat on which a Christmas tree or other potted plants or objects may be rested. Alternatively, one or more additional panels (such as 78*c* and 80*c*) can be used to support the single panel 76*c* to form an entirely separate game structure, as shown in FIGS. 9E and 9F. The detachable attachment mechanisms 90*c* and 91*c* can be used to attach the panels 76*c*, 78*c* and 80*c* together to form the structures shown in FIGS. 9E and 9F.

As with the structures 50 and 50*b*, the structure 50*c* can be folded and collapsed in a variety of different ways. For example, the steps illustrated in FIGS. 6A–6D can be used to fold and collapse the structure 50*c*, with the detachable connectors 90*c* either attached or detached.

As another example, all the panels 76*c*, 78*c*, 80*c*, 82*c* of module 54*c* can be removed and separated, as shown in FIG. 9, and each panel 76*c*, 78*c*, 80*c*, 82*c* of the upper module 54*c* can be placed one on top of the other to form a stack of four panels that can be folded and collapsed separately from the module 52*c*. The module 52*c* can be twisted and folded in the manner described above in connection with FIGS. 3(C)–3(E). Alternatively, the stack of four panels 76*c*, 78*c*, 80*c*, 82*c* of the upper module 54*c* can be placed on top of the stack of four panels 56*c*, 58*c*, 60*c*, 62*c*, and the combined stack of eight panels can be twisted and folded in the manner described above in connection with FIGS. 3(C)–3(E).

Figure 10:
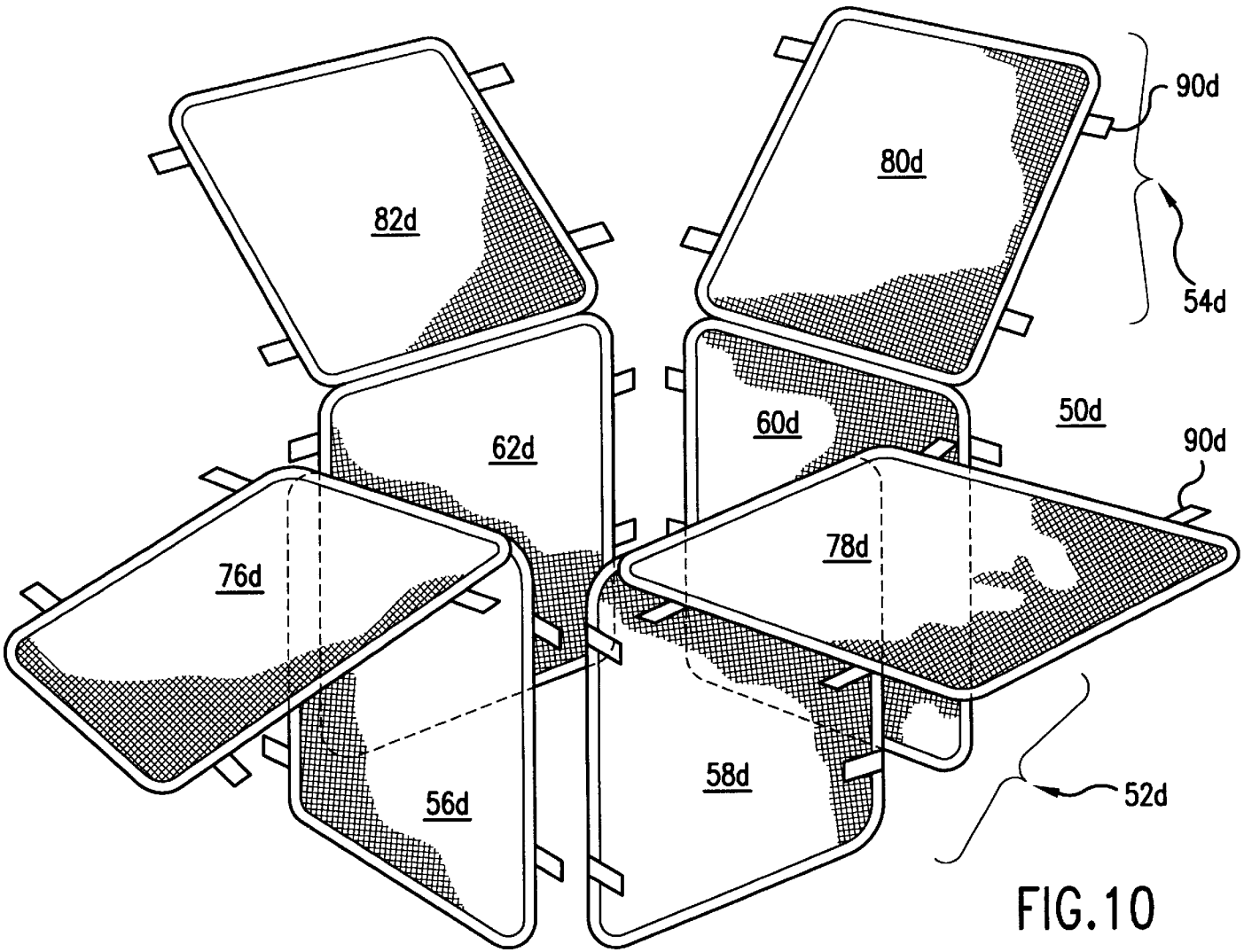

Structure 50*d* in FIG. 10 further extends the principles illustrated in FIGS. 5, 7, 8 and 9. The elements of the structure 50*d* that are the same as the elements of the structures 50–50*c* are provided with the same numeral designations except that a "d "has been added to the numeral designations in FIG. 10. In FIG. 9, all the side panels 56*d*, 58*d*, 60*d*, 62*d* of the lower module 52*d* and all the side panels 76*d*, 78*d*, 80*d*, 82*d* of the upper module 54*d* are provided as separate side panels from the other side panels in the same module. However, each side panel 56*d*, 58*d*, 60*d*, 62*d* of the lower module 52*d* is stitched at its top edge to the bottom edge of the corresponding side panel 76*d*, 78*d*, 80*d*, 82*d* of the upper module 54*d*. Opposing sets of detachable connectors 90*d* are provided to detachably attach each side edge of each panel 56*d*, 58*d*, 60*d*, 62*d*, 76*d*, 78*d*, 80*d*, 82*d* to an adjacent side edge of an adjacent panel. In other words, each vertical pair of side panels (i.e., 56*d* and 76*d*, 58*d* and 78*d*, 60*d* and 80*d*, and 62*d* and 82*d*) are provided together. The configuration of the structure 50*d* offers different variety in play and use. For example, the user can choose to completely remove one pair of vertical panels (e.g., 56*d* and 76*d*), and use the other three pairs of vertical panels (58*d* and 78*d*, 60*d* and 80*d*, and 62*d* and 82*d*) to form a three-sided structure. Or, two adjacent pairs of vertical panels (e.g., 56*d* and 76*d*, 58*d* and 78*d*) can be separated from the other pair of vertical panels (60*d* and 80*d*, 62*d* and 82*d*) to form other structures: for example, (1) two adjacent pairs of vertical panels (e.g., 56*d* and 76*d*, 58*d* and 78*d*) can be used to form one of the basic modules by using one side edge of each panel 56*d*, 76*d*, 58*d*, 78*d* as the bottom edge; or (2) each of the two pairs of vertical panels can be used as partitions, or for any other purpose.

As with the structures 50–50*c*, the structure 50*d* can be folded and collapsed in a variety of different ways. For example, the steps illustrated in FIGS. 6A–6D can be used to fold and collapse the structure 50*d*.

As another example, all detachable attachments 90*d* can be detached to separate each pair of vertically-connected panels (56*d* and 76*d*, 58*d* and 78*d*, 60*d* and 80*d*, and 62*d* and 82*d*), as shown in FIG. 10, and each pair of vertically-connected panels can be folded about each other at their hinged connections to form four separate stacks of two panels 56*d* and 76*d*, 58*d* and 78*d*, 60*d* and 80*d*, and 62*d* and 82*d*. Each of the four stacks can be placed one on top of each other, and the combined stack of eight side panels can be twisted and folded in the manner described above in connection with FIGS. 3(C)–3(E).

Figure 11:
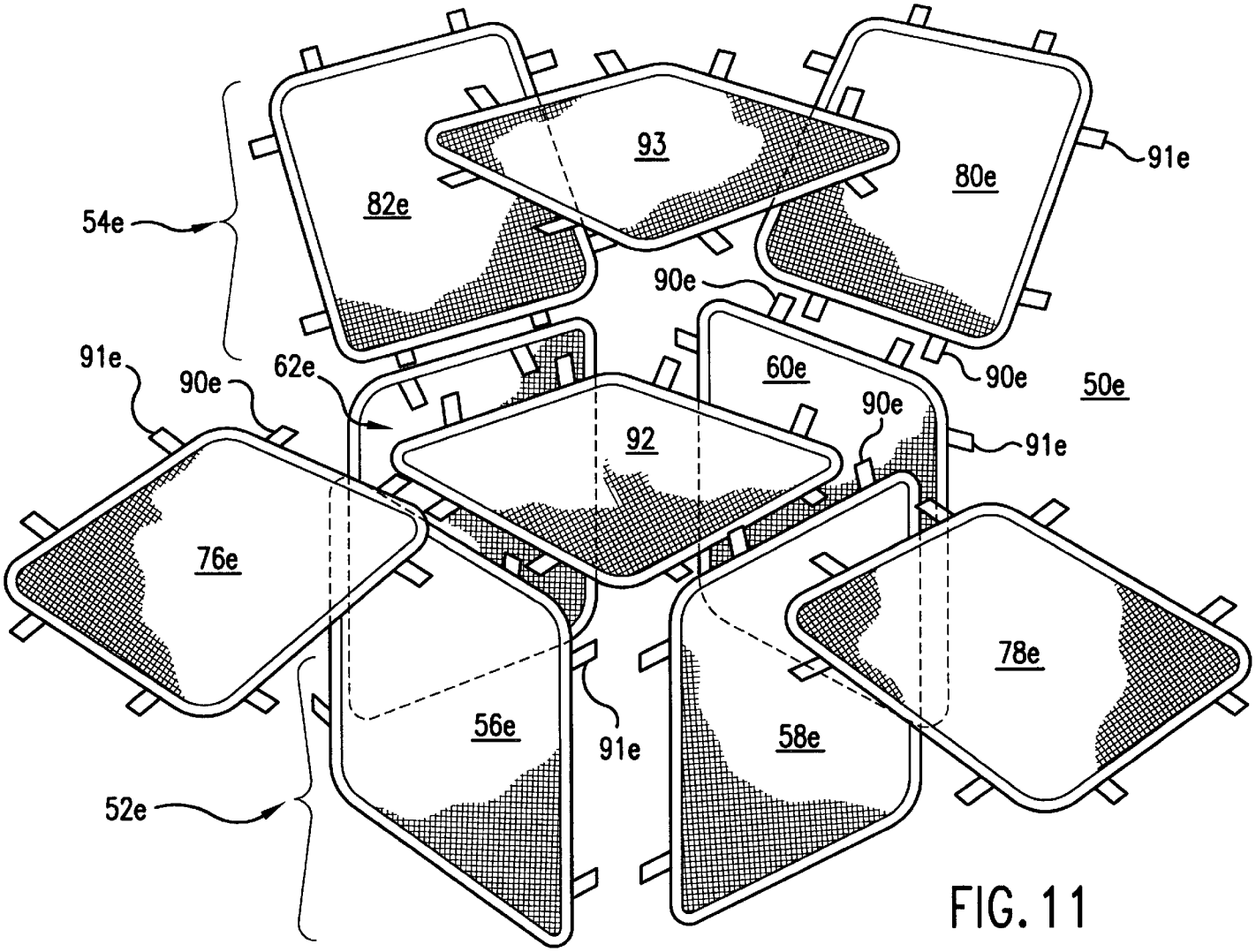

Structure 50*e* in FIG. 11 further extends the principles illustrated in FIGS. 9 and 10. The elements of the structure 50*e* that are the same as the elements of the structures 50*c* and 50*d* are provided with the same numeral designations except that an "e" has been added to the numeral designations in FIG. 11. In FIG. 11, all the side panels 56*e*, 58*e*, 60*e*, 62*e*, 76*e*, 78*e*, 80*e*, 82*e* can be provided separately, with opposing sets of detachable attachments 90*e* and 91*e* used to assemble any of the side panels to provide any resulting configuration, including the configuration shown in FIGS. 4 and 11. In addition to the vertical side panels, one or more horizontal panels, such as 92 and 93, having detachable attachment mechanisms, can have each of its four sides detachably attached to corresponding side panels in either module 52*e* or 54*e* to function as a table top, roof, floor, central divider (between the modules 52*e*, 54*e*), or partition, among others. As another example, panel 93 can have only one side detachably attached to one of the side panels 76*e*, 78*e*, 80*e*, 82*e* so that panel 93 can operate as a lid. The configuration of the structure 50*e* offers the greatest flexibility and variety in play and use, since the separated side panels can be used to construct structures of almost any desired configuration, including those illustrated in FIGS. 9A–9F.

As with the structures 50–50*d*, the structure 50*e* can be folded and collapsed in a variety of different ways. For example, the steps illustrated in FIGS. 6A–6D can be used to fold and collapse the structure 50*e*. As another example, all the panels 56*e*, 58*e*, 60*e*, 62*e*, 76*e*, 78*e*, 80*e*, 82*e* can be removed and separated, as shown in FIG. 11, and each panel can be placed one on top of the other to form a stack of eight to ten side panels that can be folded and collapsed in the manner described above in connection with FIGS. 3(C)–3(E).

The upper modules 54–54*e* can be replaced by other panels to form structures having different configurations. For example, the structure 50*f* in FIG. 12 has a lower module 52*f* that can be the same as any of the lower modules 52–52*e* illustrated above, but the upper module has been replaced by a pair of angled panels 100, 102 that operate as a roof. Opposing detachable attachment mechanisms 90*f* can be used to detachably connect the top edge of side panel 56*f* and the bottom edge of panel 100, and the bottom edge of panel 102 can be either stitched or detachably connected to the top edge of the side panel 60*f*. In addition, the top edges of the panels 100, 102 can be either stitched or detachably connected to each other, to form an angled roof or domed top for the structure 50*f*. The panels 100, 102 can assume any configuration and can have any number of side edges.

The structure 50*f* can be folded and collapsed by detaching the detachable attachment mechanisms 90*f*, folding the panel 100 about its connection with panel 102, and then folding the combined panels 100, 102 about the connection with panel 60*f*. The lower module 52*f* (with the two panels 100, 102 stacked against side panel 60*f*) can then be folded and collapsed in the manner described above in connection with FIGS. 3(C)–3(E). Alternatively, if the connection between panels 60*f* and 102 is detachable, then the panels 100, 102 can be removed from the lower module 52*f* and folded and collapsed separately from lower module 52*f*, or together with lower module 52*f*.

Figure 13:
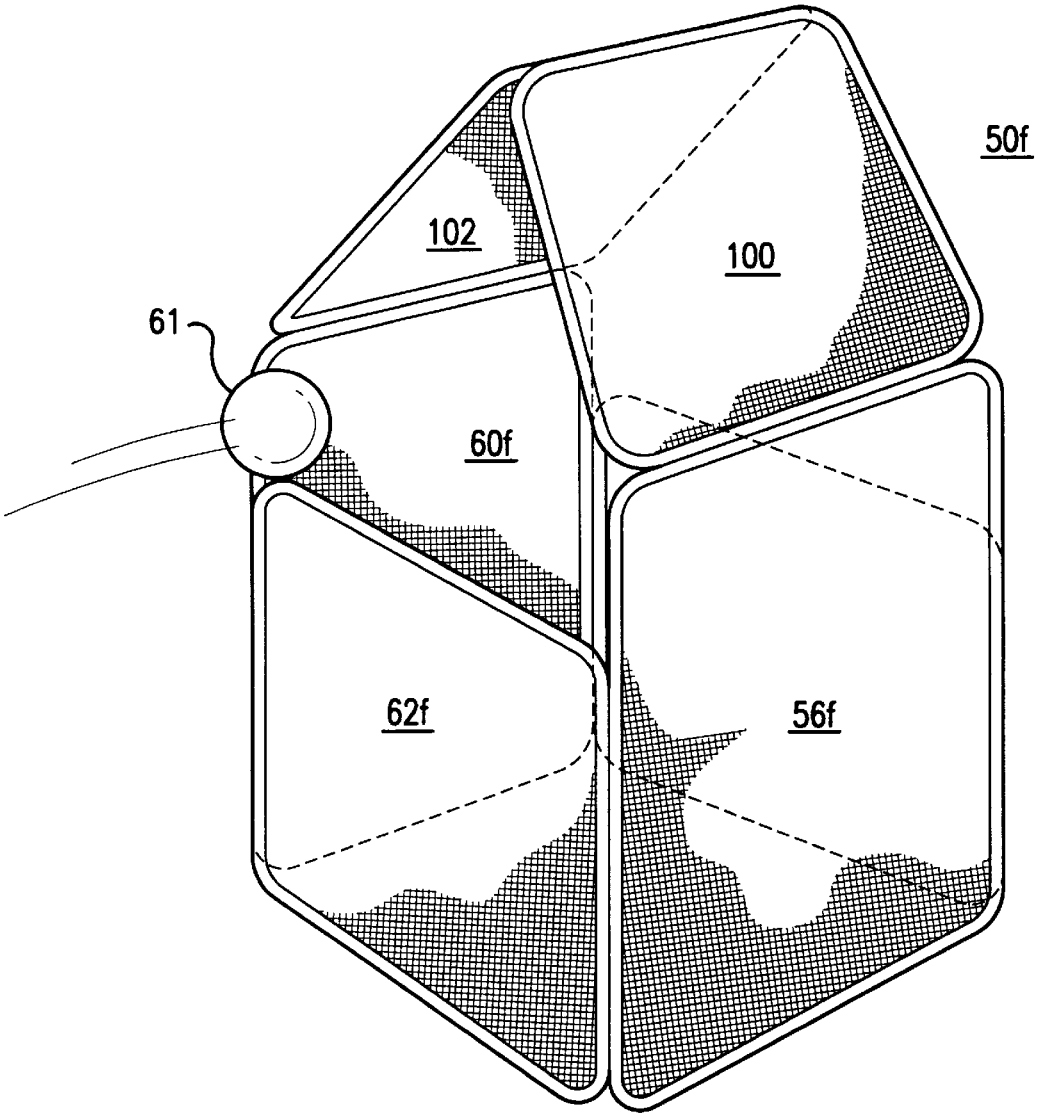

FIG. 13 illustrates the structure 50*f* with a small modification. The side panels 58*f* and 62*f* have been provided with a shorter vertical height to provide a larger clearance or opening between the top of the panels 58*f*, 62*f* and the top panels 100, 102. In fact, one or both of these side panels 58*f*, 62*f* can operate as a hinged door if one of the side edges of the panels 58*f*, 62*f* is connected to an adjacent panel 56*f* and/or 60*f* by opposing detachable attachment mechanisms. For example, if the adjacent side edges of panels 62*f* and 56*f* are detachably connected, then the detachable attachment mechanism can be detached and the panel 62*f* swung open about the connection between the panels 62*f* and 60*f*. A ball 61 can even be tossed through the opening 63 defined by the panels 62*f*, 56*f*, 60*f*, 100, 102.

Figure 12:
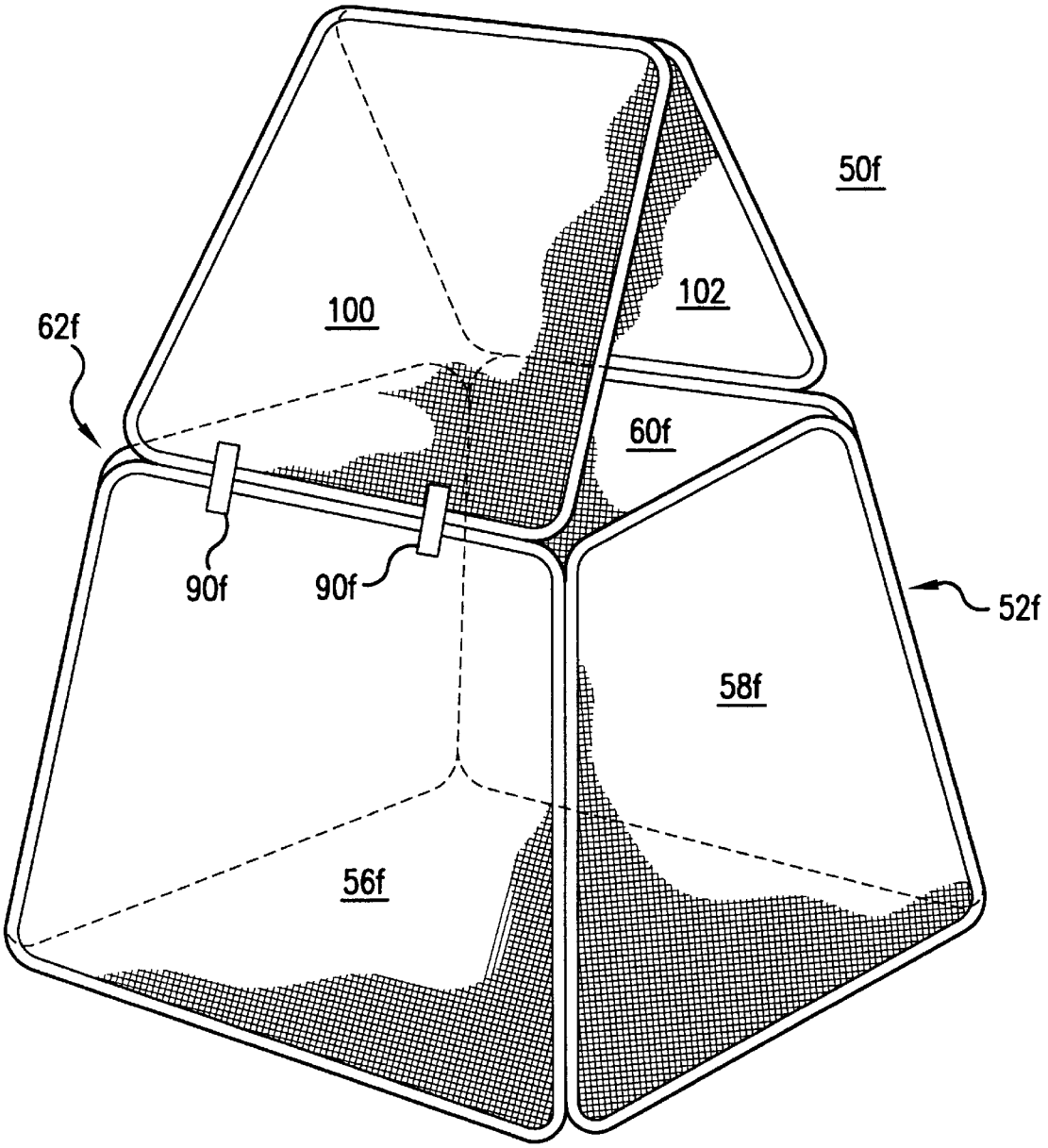

In addition, as shown in FIG. 12, the side panels 56*f*, 58*f*, 60*f*, 62*f* can have side edges that are slanted or angled inwardly, so that the top edge is shorter than the bottom edge. This configuration facilitates a domed structure with the top panels 100, 102 forming the top of the dome.

Figure 14:
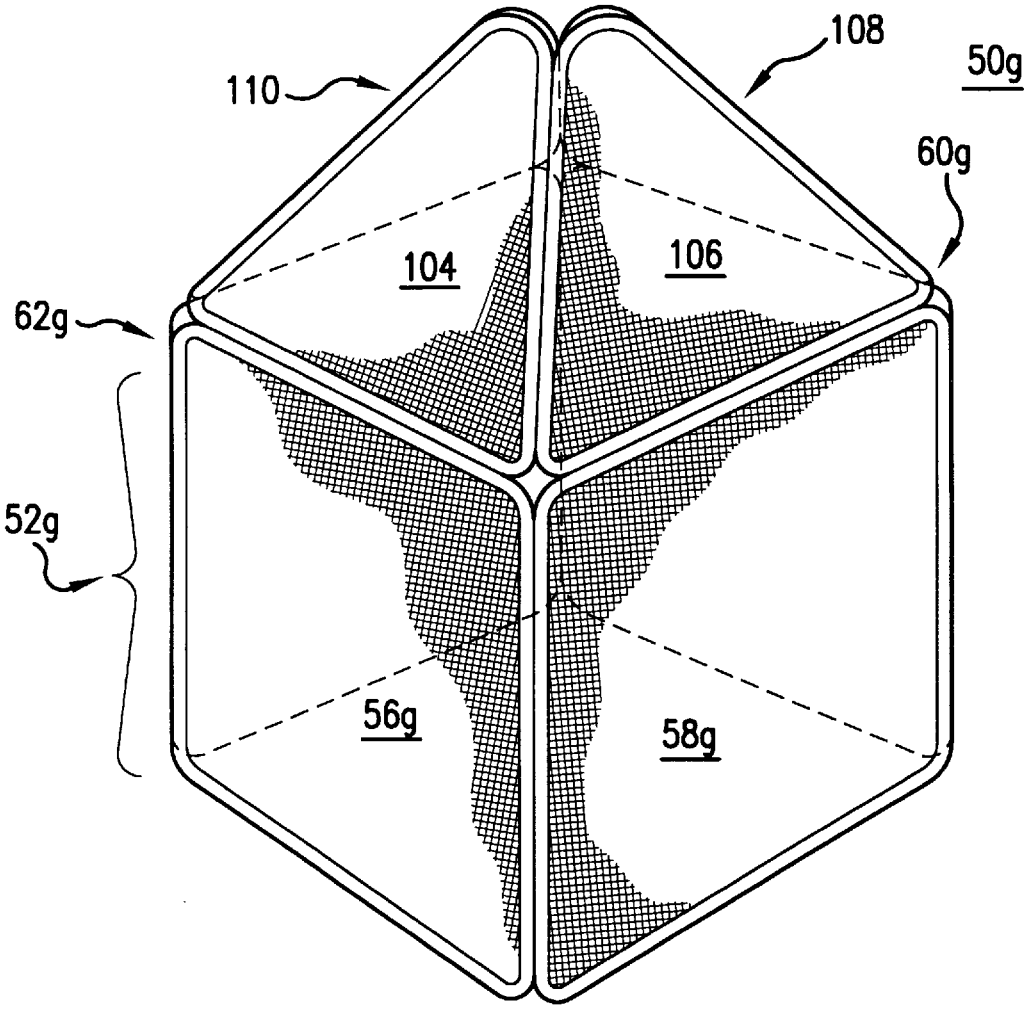

Structure 50*g* of FIG. 14 further extends the principles illustrated in FIG. 12. The elements of the structure 50*g* that are the same as the elements of the structure 50*f* are provided with the same numeral designations except that a "g" has been added to the numeral designations in FIG. 14. The structure 50*g* also has a lower module 52*g*, but the two top panels 100, 102 have been replaced by four top three-sided panels 104, 106, 108 and 110 that are angled towards the top to form a domed roof. The bottom edge of each top panel 104, 106, 108, 110 is either stitched or detachably connected to a top edge of a corresponding side panel 56*g*, 58*g*, 60*g*, 62*g*, respectively, and each side edge of each top panel 104, 106, 108, 110 is either stitched or detachably connected to a side edge of an adjacent top panel. All the connections can be stitched connections according to FIGS. 2A or 2B, or any number of these connections can be detachable connections.

As with the structures 50–50*e*, the structure 50*g* can be folded and collapsed in a variety of different ways. For example, the steps illustrated in FIGS. 6A–6D can be used to fold and collapse the structure 50*g*, with the top panels 104, 106, 108, 110 folded in the same manner as panels 76, 78, 80, 82. As another example, all the separate panels (i.e., those without any stitched connections) can be removed and separated, and each separate panel can be placed one on top of the other to form a stack of separate panels. The panels that are stitched to other panels can be folded about their hinged connections using any of the techniques described above to form another stack of stitched panels. The two stacks of panels can in turn be placed on top of each other and then folded and collapsed in the manner shown in FIGS. 3(C)–3(E).

Figure 15:
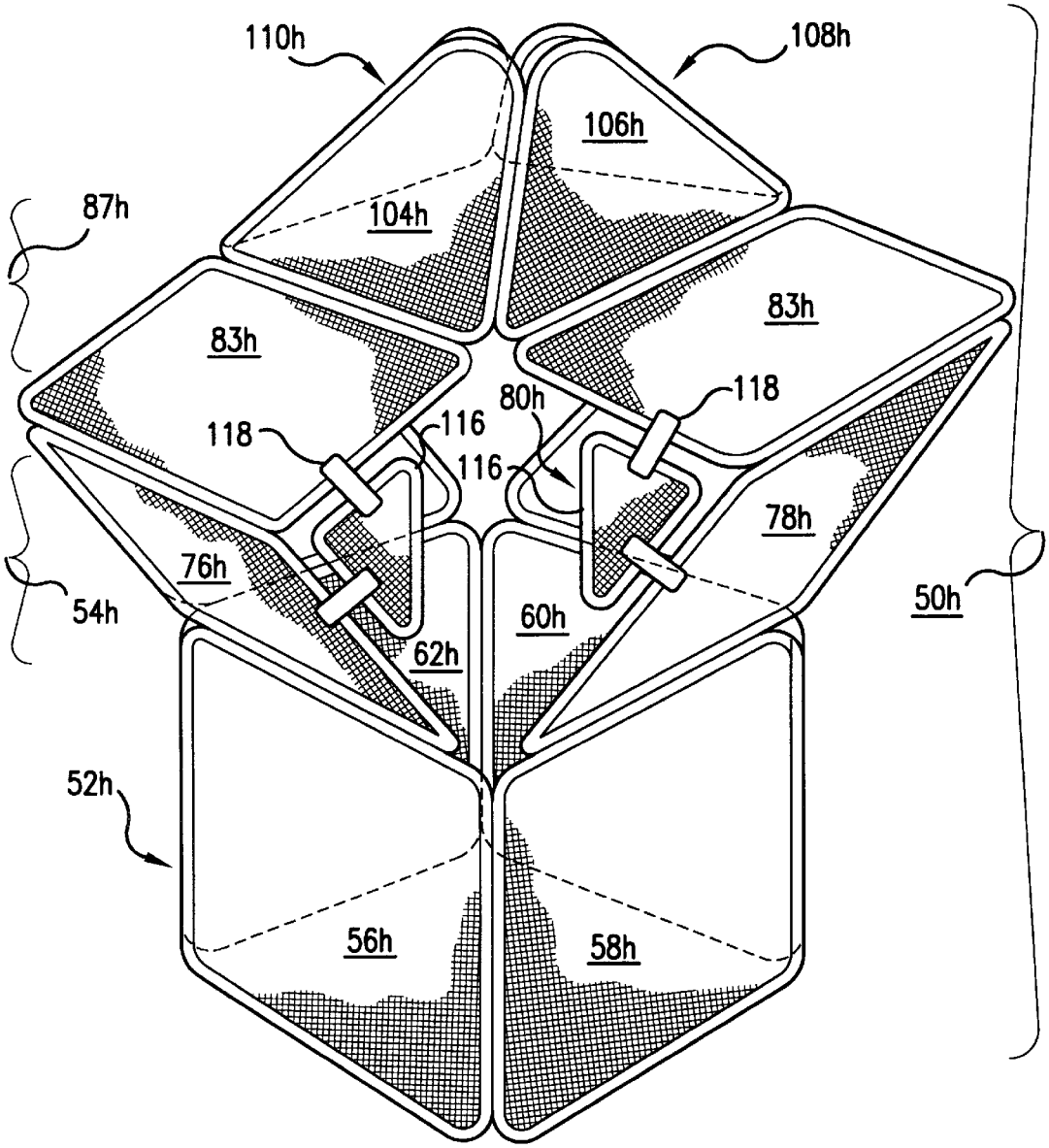

Structure 50*h* in FIG. 15 further extends the principles illustrated in FIGS. 8, 8A and 14. The elements of the structure 50*h* that are the same as the elements of the structures 50*b*, 50*g* are provided with the same numeral designations except that an "h" has been added to the numeral designations in FIG. 15. The structure 50*h* is essentially the same as structure 50*b* shown in FIG. 8A, but with the top panels 104*h*, 106*h*, 108*h*, 110*h* either stitched or detachably connected to the top edge of each of the four panels 83*h* of the module 87*h*. All the side edges of all the panels in each of modules 52*h*, 54*h*, 87*h*, as well as the side edges of top panels 104*h*, 106*h*, 108*h*, 110*h*, can be stitched or detachably connected together.

Alternatively, since the vertical height of the structure 50*h* can be quite high, the panels of the middle modules 54*h* and 87*h* can be bent at an angle and supported by one or more optional support panels 116. Each support panel 116 can have the same construction as any of the other panels described herein, but can assume a different shape (e.g., triangular in this case) to properly support the panels of the middle modules 54*h*, 87*h*. Each support panel 116 can be provided with detachable attachment mechanisms 118, each mechanism 118 used to detachably attach one side of the support panel 116 to one side of a panel of module 54*h* or module 87*h*. The support panels 116 prevent the panels 83*h* of the module 87*h* from collapsing on to the panels of the module 54*h* by using two of its sides to brace or support the side edges of the panels of the middle modules 54*h*, 87*h* at any desired angle. Thus, structure 50*h* illustrates that the principles of the present invention can be utilized to assemble a great variety of structures. Structure 50*h* can be folded and collapsed using similar techniques as for structures 50*b* and 50*g*.

Figure 16:
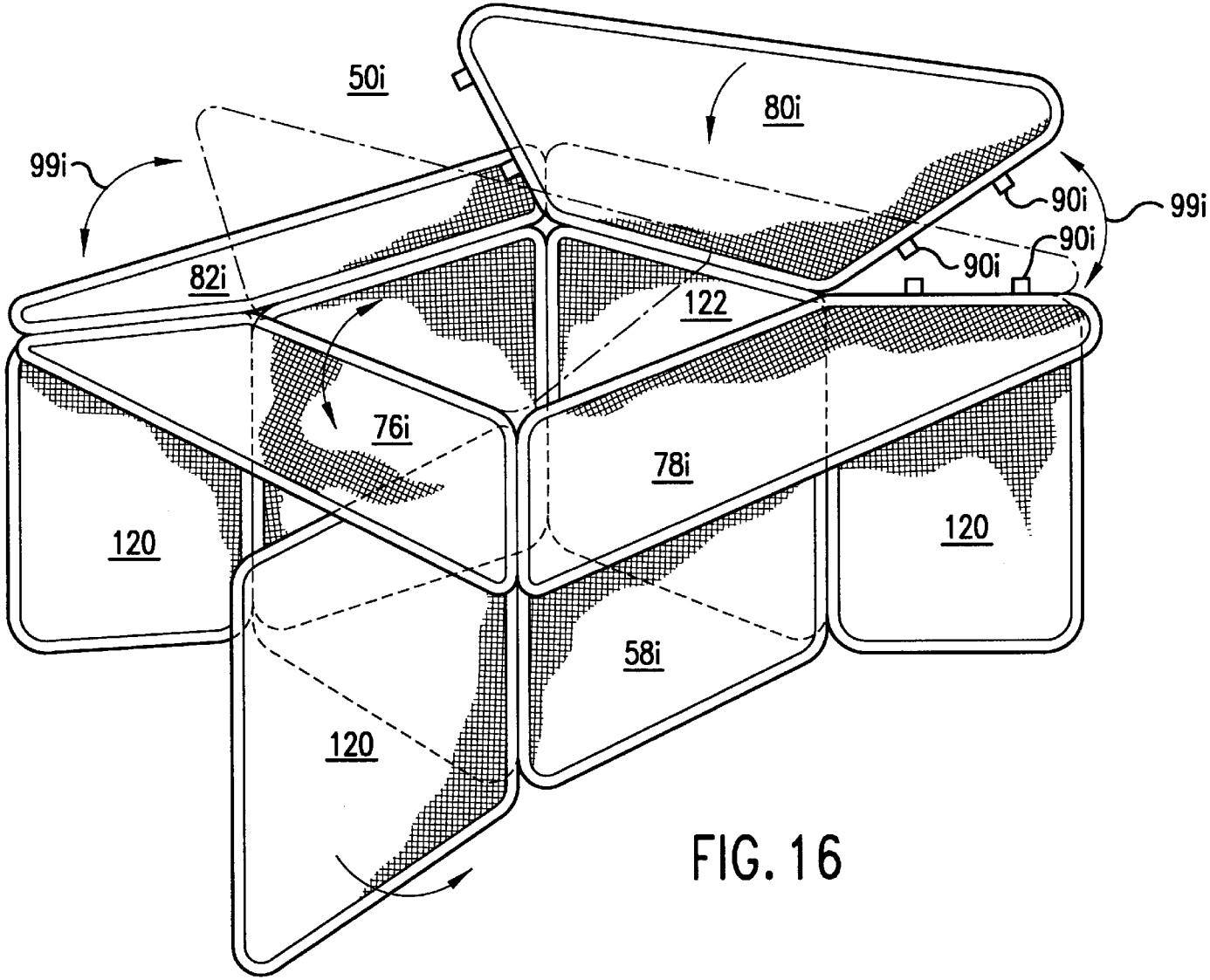
Figure 16A:
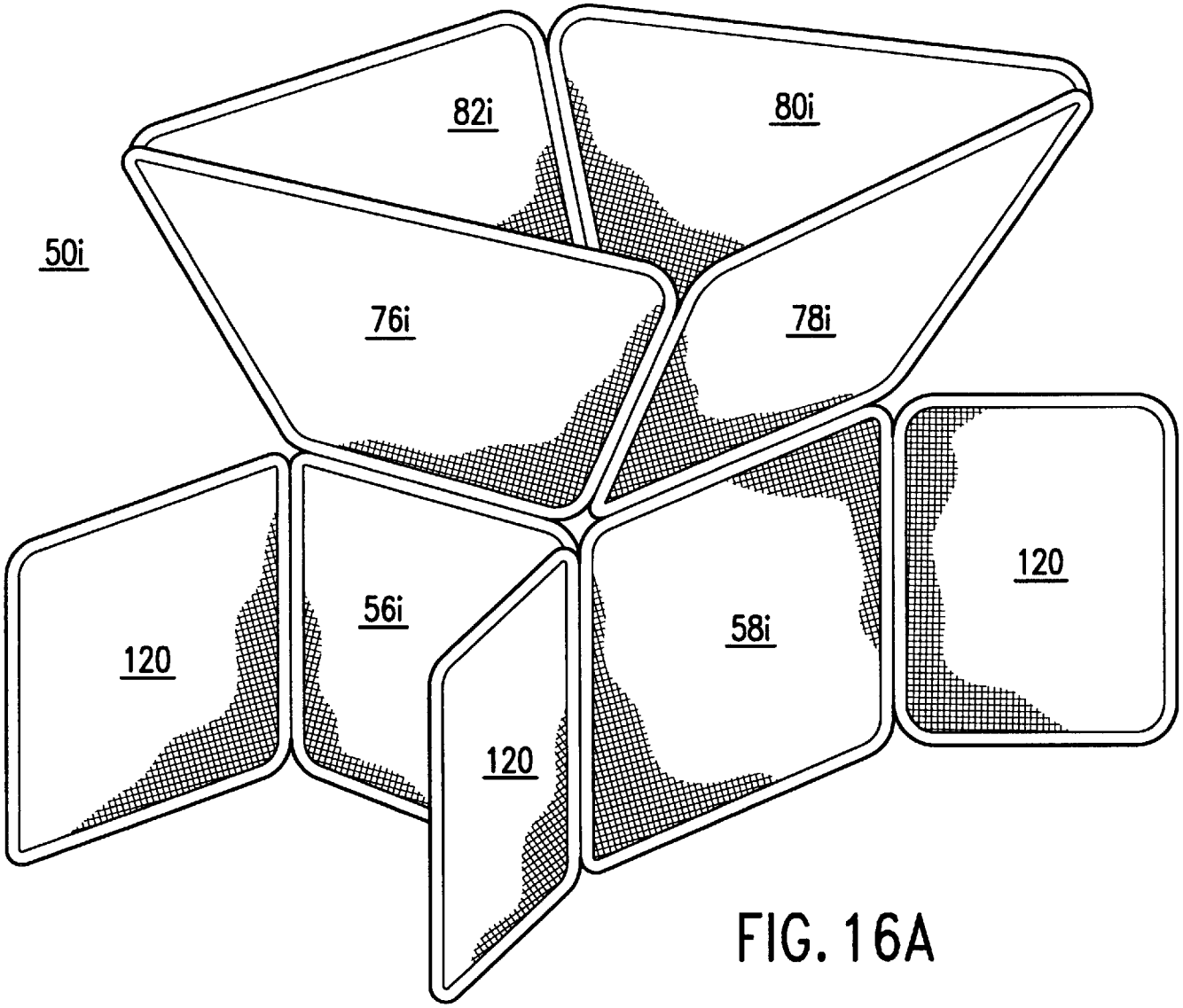

Structure 50i in FIGS. 16 and 16A further extends the principles illustrated in FIG. 8. The elements of the structure 50*i* that are the same as the elements of the structures 50*b* are provided with the same numeral designations except that an "i" has been added to the numeral designations in FIGS. 16 and 16A. The panels 76*i*, 78*i*, 80*i*, 82*i* in structure 50*i* have a slightly different configuration (a truncated triangle) from the panels 87*b*, 78*b*, 80*b*, 82*b*: the upper edge of each panel 76*i*, 78*i*, 80*i*, 82*i* is longer than the lower edge that connects the upper edge of the panels 56*i*, 58*i*, 60*i*, 62*i*, and the side edges of each panel 76*i*, 78*i*, 80*i*, 82*i* extend at an angle between the upper and lower edges. Thus, when the panels 76*i*, 78*i*, 80*i*, 82*i* are connected to each other, they form an upper funnel (see FIG. 16A) that has a larger opening than the top opening defined by the panels 56*i*, 58*i*, 60*i*, 62*i*.

Structure 50*i* further includes from one to four support panels 120, each of which has one side edge that is stitched (such as shown in FIG. 2A) or detachably connected to the hinged connection between adjacent pairs of the panels 56*i*, 58*i*, 60*i*, 62*i*. Each support panel 120 can have the same construction (albeit with a different shape or size) as any of the other panels described herein, and can be pivoted about its hinged connection to any desired position with respect to the other panels 56*i*, 58*i*, 60*i*, 62*i*. The support panels 120 provide support (like the legs of a table) to the panels 76*i*, 78*i*, 80*i*, 82*i* when these panels 76*i*, 78*i*, 80*i*, 82*i* are folded about their hinged connections with the top edges of panels 56*i*, 58*i*, 60*i*, 62*i* in the direction of arrows 99*i* to lie horizontally on top of the support panels 120. When all the panels 76*i*, 78*i*, 80*i*, 82*i* have been positioned horizontally on top of the support panels 120, the structure 50*i* can be used as a table, with the upper panels 76*i*, 78*i*, 80*i*, 82*i* functioning as the table top, supported by the lower panels 56*i*, 58*i*, 60*i*, 62*i* and the support panels 120. To further facilitate use as a table top, a fabric or panel 122 can be connected to the top edges of the lower panels 56*i*, 58*i*, 60*i*, 62*i* to complete the table top surface.

Structure 50*i* can be folded and collapsed using similar techniques described above for the other structures 50–50*h*. In addition, the support panels 120 can either be removed, or folded against an adjacent lower panel 56*i*, 58*i*, 60*i*, 62*i* to be folded and collapsed together with the other panels.

Figure 17:
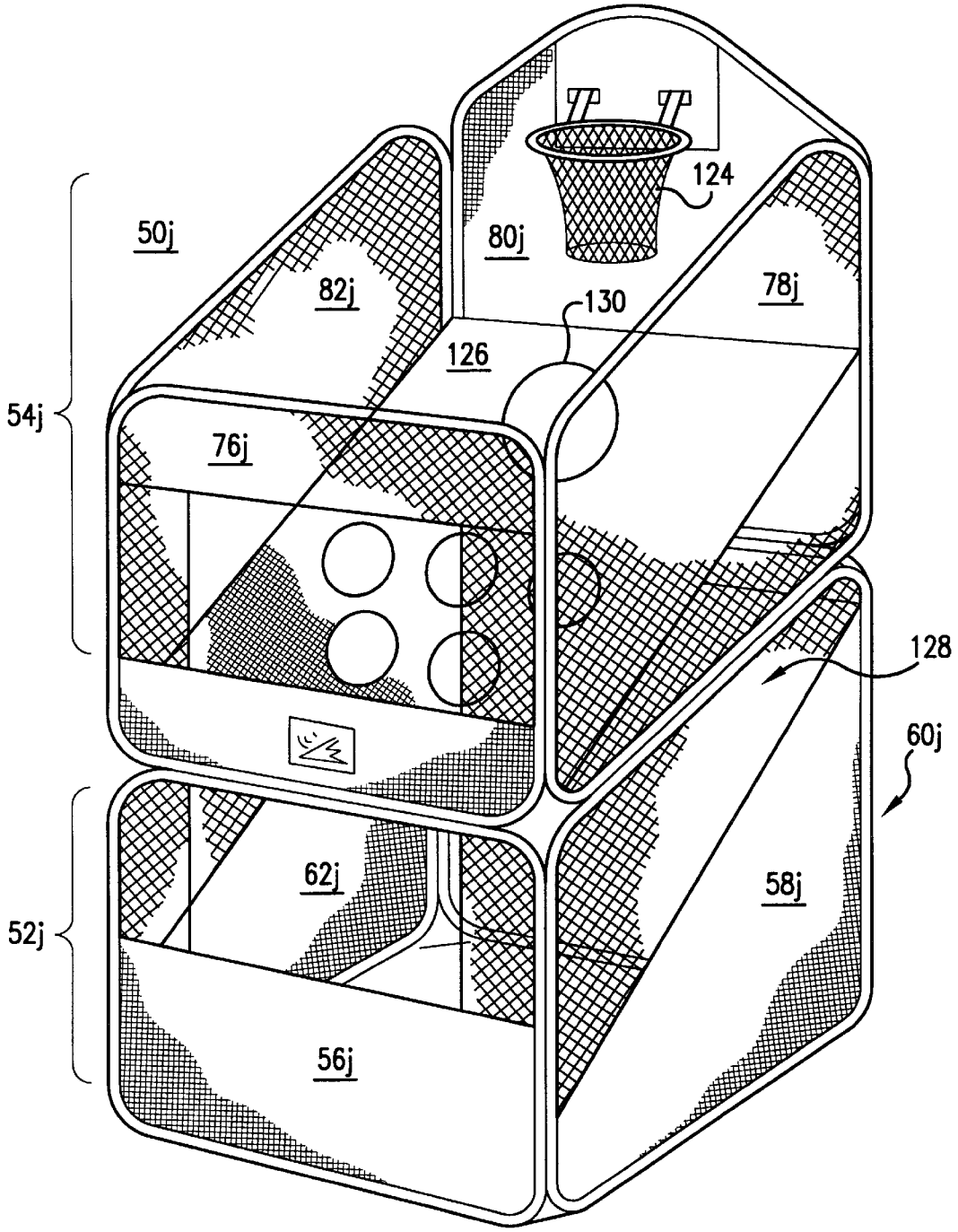
Figure 19:
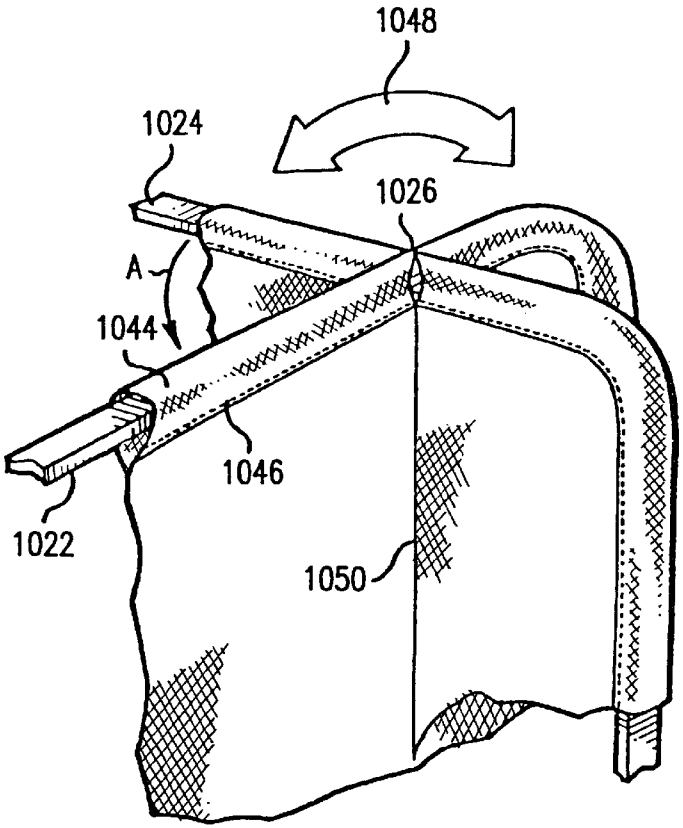
FIG. 19 is a perspective cut-away sectional view of the sunshield of FIG. 18A.

FIG. 17 illustrates a modification to the structure 50, in which the side panels are provided in a slightly different shape. The elements of the structure 50*j* that are the same as the elements of the structure 50 are provided with the same numeral designations except that a "j" has been added to the numeral designations in FIG. 17. The structure 50*j* is essentially the same as structure 50, except that the front panels 56*j*, 76*j* are shorter in height than the rear panels 60*j*, 80*j*, with the left and right panels 58*j*, 78*j*, 62*j*, 82*j* having front side edges that are shorter than the rear side edges. In addition, the top and bottom edges of side panels 78*j*, 82*j*, and the top edge of side panels 58*j*, 62*j*, can be angled from the front to the back. These features provide a structure 50*j* in which the rear panels 60*j*, 80*j* provide a backboard for a basketball-style game having a netting 124. In addition, first and second panels or fabrics 126 and 128 can extend at an angle from one location along the rear panels 60*j* and 80*j* to a location along the front panels 56*j* and 76*j*, respectively, to guide a ball to roll downwardly towards the front panels 56*j*, 76*j*. Openings 130 can even be provided in the first panel or fabric 126 to allow the ball to fall therethrough and to the second panel or fabric 128. Additional amusement features can be provided or varied as desired.

The principles of the present invention can even be applied to panels that are connected in an overlapping or crossing manner. FIGS. 18A–22 illustrate a basic structure 1020 having overlapping or crossing frame members, with the principles being applicable to the structures in FIGS. 23–25 herein below. The structure 1020 can be another basic building block that is used to illustrate the principles of the present invention, and is formed by two resilient frame members 1022 and 1024 that together define the outer boundary of the structure 1020. Referring to FIG. 22, each frame member 1022 and 1024 is provided as a closed resilient loop, either as a closed continuous loop or as a strip of material with opposing ends held together by a retaining connector or other conventional attachment mechanism to form a closed loop. The frame members 1022 and 1024 can be the same as frame members 28 above.

Figure 18A:
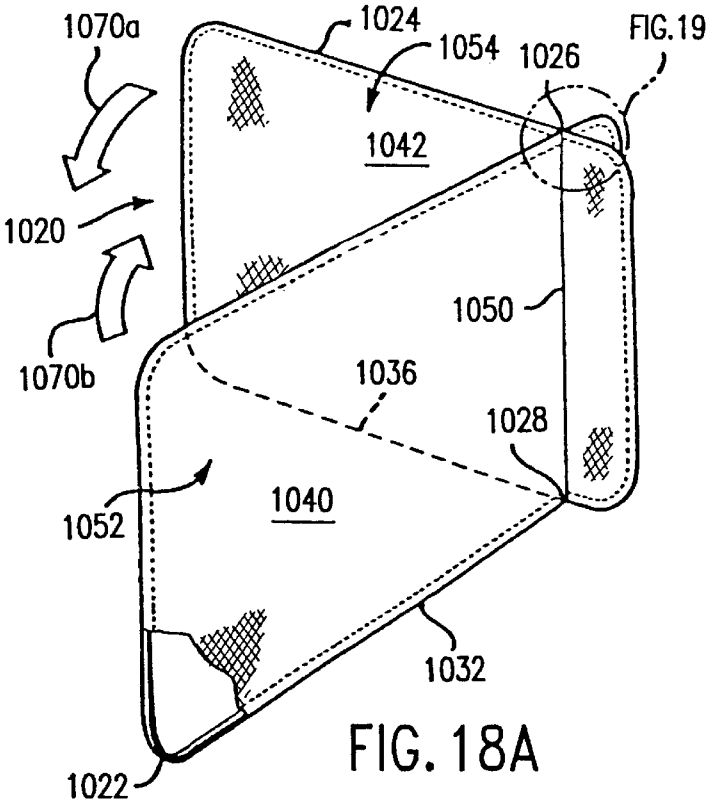
FIG. 18A is a perspective view of another structure according to an embodiment of the present invention illustrated in an expanded configuration.
Figure 18B:
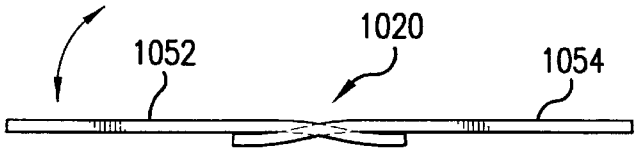
FIG. 18B is a top plan view of the structure of FIG. 18A.

As illustrated in FIG. 22, the two frame members 1022 and 1024 are fitted within each other. This can be done, for example, by providing a first frame member as a strip of material to enclose the second frame member, and then connecting the two ends of the strip of material of the first frame member. The frame members 1022 and 1024 overlap or cross-over each other at overlapping points 1026 and 1028. The overlapping point 1026 is defined by the intersection or crossing of the upper edges 1030 and 1034 of frame members 1022 and 1024, respectively, and the overlapping point 1028 is defined by the intersection or crossing of the lower edges 1032 and 1036 of frame members 1022 and 1024, respectively. The overlapping points 1026 and 1028 can be positioned anywhere along the upper edge 1030 or lower edge 1032 of the frame member 1022, and anywhere along the upper edge 1034 or lower edge 1036 of the frame member 1024. FIG. 18A illustrates the overlapping points 1026 and 1028 provided near the adjacent side edges of the two frame members 1022 and 1024. The two overlapping frame members 1022 and 1024 are pivotable about their overlapping points 1026 and 1028 between two positions, a first completely open position (see FIG. 18B) in which both frame members 1022 and 1024 lie flat in about the same plane parallel to each other and extend to the widest longitudinal length of the structure 1020, and a second folded position in which the frame members 1022 and 1024 are folded towards each other (such as in the direction of arrows 1070*a* and 1070*b* in FIG. 18A) to overlie each other.

As with frame members 28, each frame member 1022 and 1024 is retained in a frame retaining portion of one or more fabric pieces. For example, as shown in FIG. 18A, two fabric pieces 1040 and 1042 are provided, one for each frame member 1022 and 1024, respectively. Each fabric piece 1040 and 1042 completely covers, and forms a panel 1052 or 1054 that is supported by the respective frame member 1022 or 1024, and is preferably held in tension with the frame member 1022 or 1024. The fabric pieces 1040 and 1042 are preferably made from the same material as fabric 30 described above.

The frame retaining portions are preferably provided in the form of a sleeve for retaining the frame members 1022 and 1024. The frame members 1022 and 1024 may be retained at the frame retaining portions by a number of different methods, including any of those described above. For example, a sleeve 1044 may be formed by folding a peripheral edge of the fabric 1040 or 1042 over the frame member 1022 or 1024 and then applying a stitching 1046, or by providing a separately-formed tubular sleeve that is stitched along the same stitch line 1046 to the fabric 1040, 1042. Using this method, the frame members 1022 and 1024 may be left free and unsecured within the sleeves 1044. In another method, the frame members 1022 and 1024 may be mechanically fastened, glued or fused to the sleeve 1044 or the fabric 1040, 1042.

The frame members 1022 and 1024 should not be connected or attached at the overlapping points 1026 and 1028 so as to allow the frame members 1022 and 1024 to pivot about these points. The structure of the sleeve 1044 at the overlapping points 1026 and 1028 can be provided in one of several ways. In a first alternative illustrated in an exaggerated sense in FIG. 22, a small portion of the sleeves 1044 for both frame members 1022 and 1024 may be interrupted or disconnected adjacent the overlapping points 1026 and 1028 so as to expose the frame members 1022 and 1024 at these overlapping points 1026 and 1028. As a second alternative, the sleeves 1044 for both panels 1052 and 1054 can be connected to each other to form a "+" or cross-shaped sleeve portion at the overlapping points 1026 and 1028 (see FIG. 19). As a third example, the respective sleeves 1044 for both panels 1052 and 1054 can run uninterrupted throughout the closed loop of the frame members 1022 and 1024. Thus, the frame members 1022 and 1024 pivot about the overlapping points 1026 and 1028 in the two directions illustrated by arrow 1048 in FIG. 19, with the overlapping points 1026 and 1028 together acting as a hinge mechanism when the frame members 1022 and 1024 are pivoted about these points 1026 and 1028 at the same time. To better define the overall hinge mechanism created by the overlapping portions 1026 and 1028, this hinge mechanism may optionally include a stitch line 1050 along which the two fabric pieces 1040 and 1042 are stitched together. The stitch line 1050 extends from one overlapping point 1026 to the other overlapping point 1028, and assists in maintaining the frame members 1022 and 1024 at about the same overlapping points 1026 and 1028 even though the frame members 1022 and 1024 are not connected or attached to each other. Thus, the two side panels 1052 and 1054 defined by the frame members 1022 and 1024, respectively, may also be hinged and pivoted about the stitch or pivot line 1050.

Figures 20A, 20B:
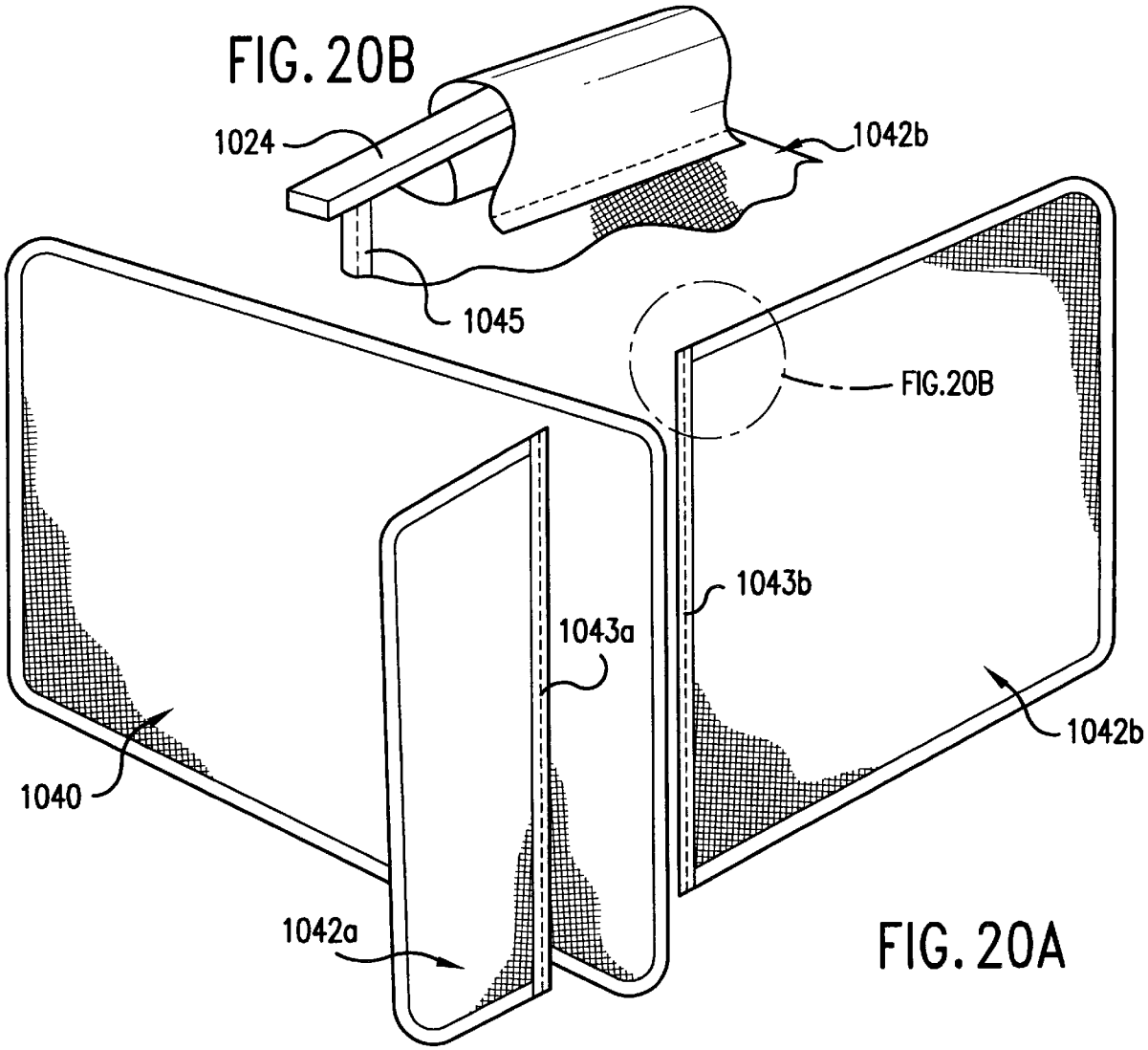
FIG. 20A is perspective exploded view illustrating one embodiment of how the fabric pieces are deployed in the frame members of FIG. 18A.
FIG. 20B is a perspective cut-away sectional view of the frame member and fabric of FIG. 20A taken along section B—B thereof.

Referring now to FIG. 20A, the first fabric piece 1040 can be provided in the form of a single piece of fabric that spans the space between the frame member 1022. The second fabric piece 1042 can be provided in the form of two separate portions of fabric, 1042*a* and 1042*b*. Each separate portion 1042*a*, 1042*b* has an inner edge 1043*a*, 1043*b*, respectively, that does not have, or is not attached to, a sleeve 1044, but is instead stitched or otherwise attached to the first fabric 1040 to form the stitch line 1050. This is illustrated in greater detail in FIG. 20B, where a small strip 1045 of the inner edge 1043*b* is folded and stitched to the first fabric 1040. It should be noted that although FIGS. 20A and 20B appear to show that the frame member 1024 has been separated, this is not true since the frame member 1024 is illustrated in this manner because of the exploded nature of these illustrations. Only the fabric portions 1042*a* and 1042*b* are separated, and as shown in greater detail in FIG. 20B, the frame member 1024 extends past the overlapping points 1026 and 1028.

Figure 21:
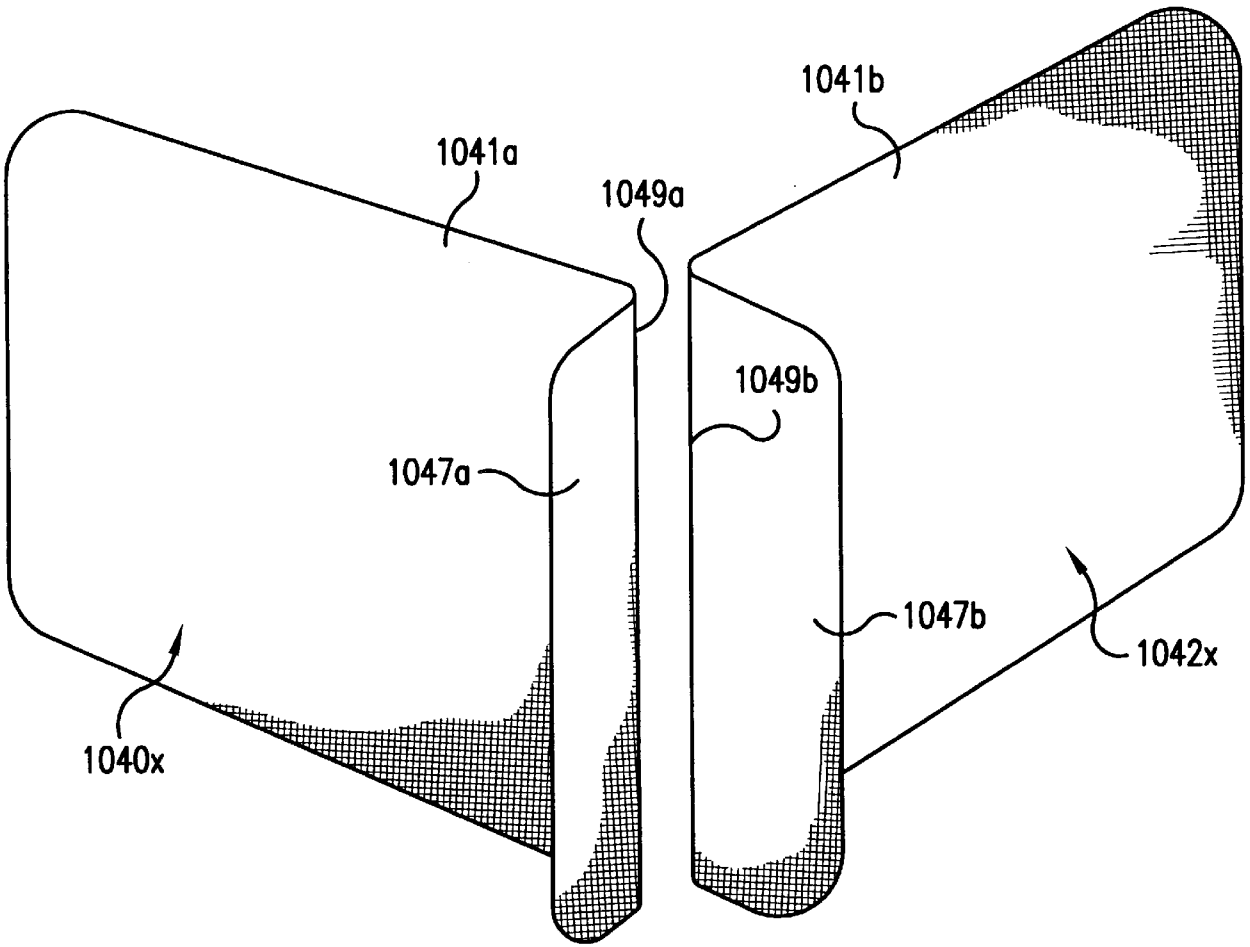
FIG. 21 is perspective exploded view illustrating another embodiment of how the fabric pieces are deployed in the frame members of FIG. 18A.
Figure 22:
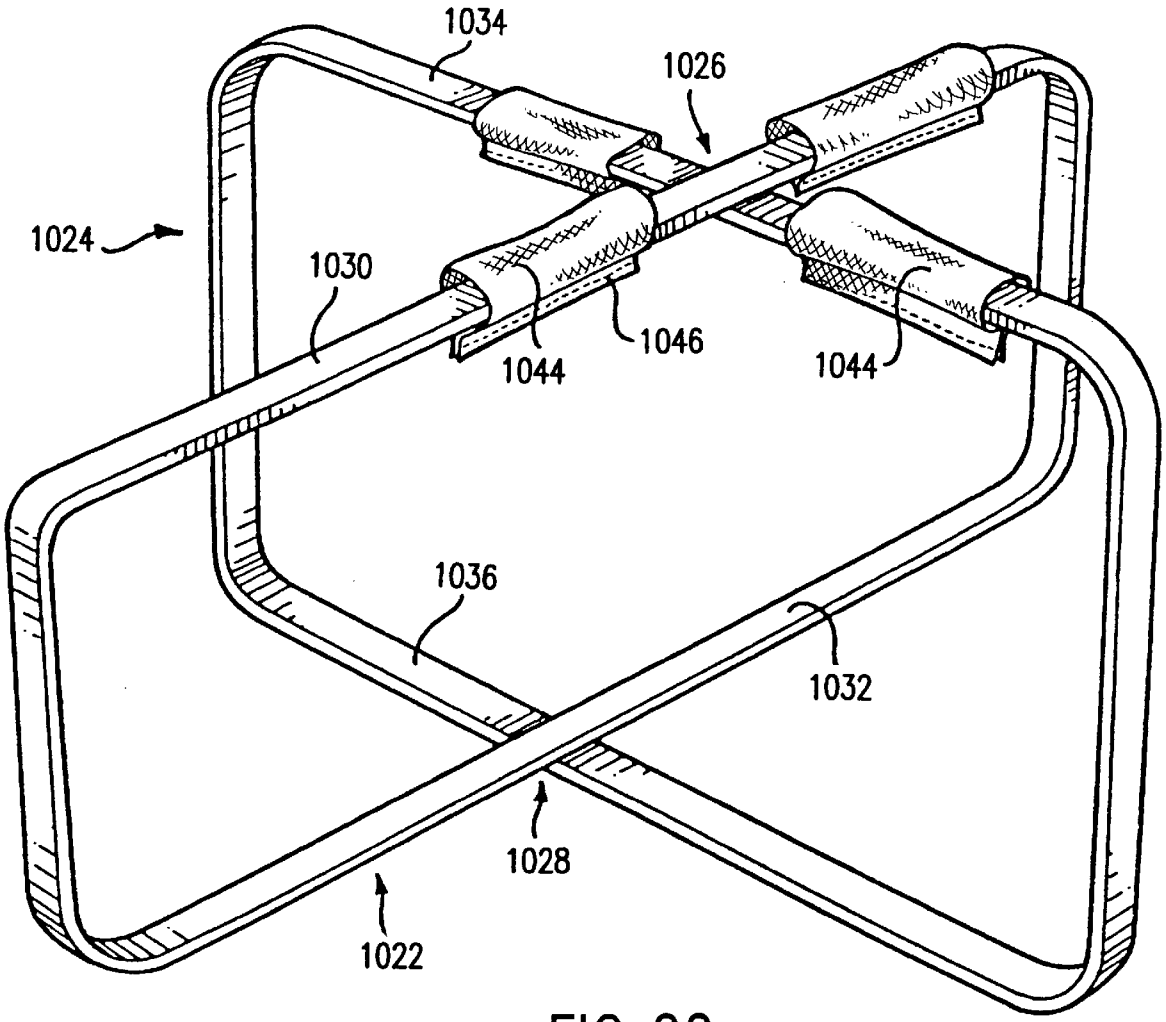
FIG. 22 is a perspective view of the frame members that can be used to support the structure of FIG. 18A.

FIG. 21 illustrates another technique of attaching the fabric pieces 1040, 1042 to the frame members 1022, 1024. In this embodiment, only two fabric pieces 1040*x*, 1042*x* are provided, and each is adapted to span across and cover portions of both frame members 1022, 1024 (the frame members 1022, 1024 are not shown in FIG. 21). Specifically, the first fabric piece 1040*x* has a first portion 1041*a* that covers or spans the majority of the first frame member 1022 and is folded along a fold line 1049*a* to form a second portion 1047*a* that covers or spans a small portion of the second frame member 1024. Similarly, the second fabric piece 1042*x* has a first portion 1041*b* that covers or spans the majority of the second frame member 1024 and is folded along a fold line 1049*b* to form a second portion 1047*b* that covers or spans a small portion of the first frame member 1022. The fold lines 1049*a*, 1049*b* can be stitched together to form the stitch line 1050.

It will also be appreciated that the frame retaining portion or sleeve 1044 can be provided either at the periphery of the fabric 1040 and 1042, as shown in FIGS. 18A–21, or at a portion of the fabric 1040 and 1042 interior from the periphery. The only requirement is that the frame members 1022 and 1024 be positioned so that they can sufficiently support the structure 1020. The structure 1020 can be used for a variety of applications, including use as automobile sunshields, partitions, game and amusement structures, mats, covers, lids, and many others.

Figure 23:
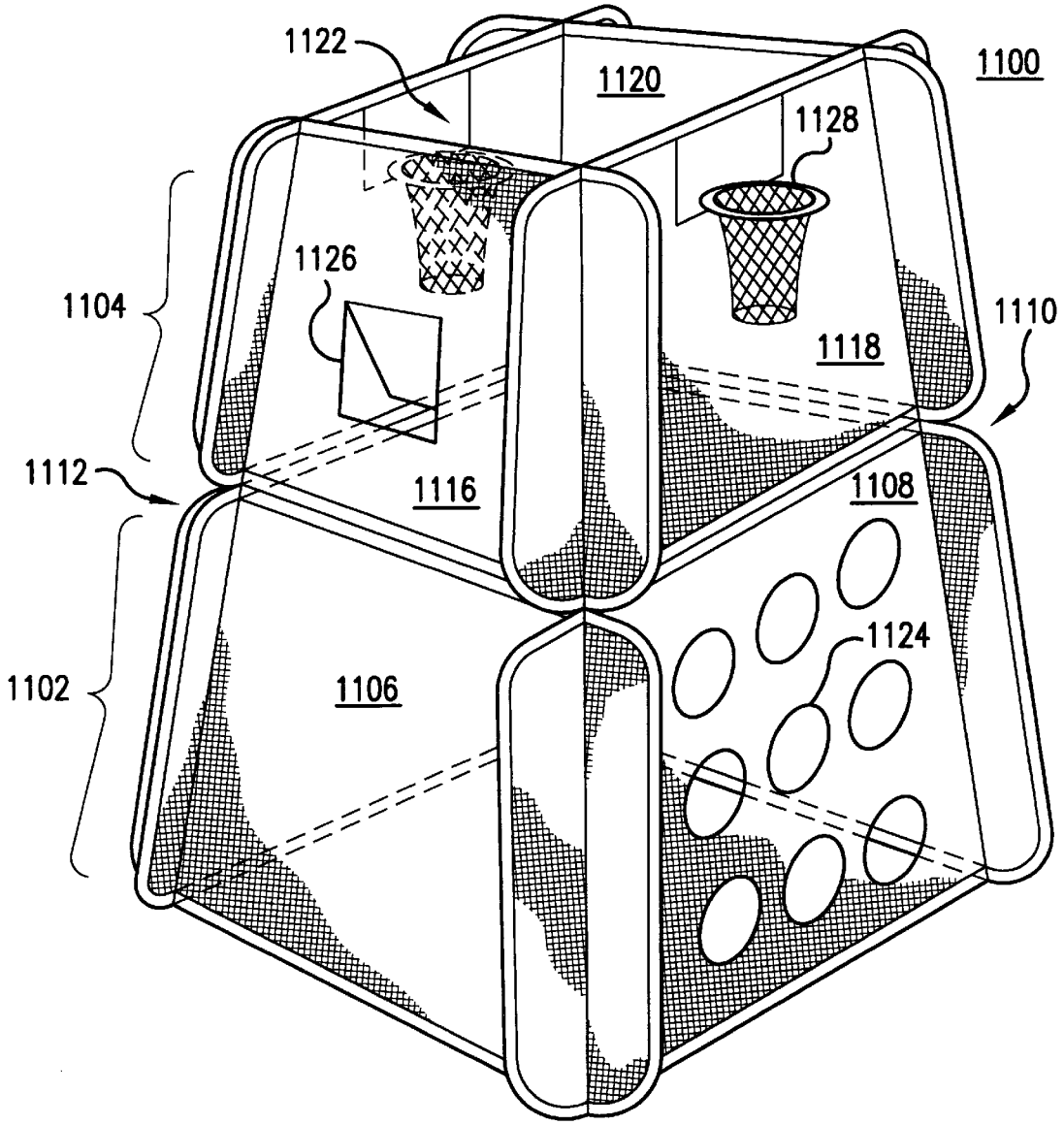
FIG. 23 is a perspective view of a collapsible structure according to another preferred embodiment of the present invention utilizing the principles illustrated in FIGS. 18A–22.

The structure 1100 in FIG. 23 incorporates the principles illustrated in FIGS. 4–6 and 18A–22. The structure 1100 has two modules 1102 and 1104, each having four side panels that are connected in the overlapping manner described in FIGS. 18A–22. Specifically, lower module 1102 has four side panels 1106, 1108, 1110 and 1112, and upper module 1104 has four side panels 1116, 1118, 1120, 1122, each having opposing side edges that are overlapped with a side edge of an adjacent side panel in the manner described above for panels 1052, 1054. In addition, the top edge of each side panel 1106, 1108, 1110, 1112 of the lower module 1102 is stitched according to FIGS. 2A or 2B, or detachably connected, to the bottom edge of each corresponding side panel 1116, 1118, 1120, 1122, respectively, of the upper module 1104. Amusement features such as openings 1124, 1126 and nettings 1128 can be provided on any of the panels.

The structure 1100 can be folded and collapsed using the same technique illustrated in FIGS. 6A–6D. Alternatively, if the modules 1102 and 1104 can be separated, then each module 1102, 1104 can be folded and collapsed separately using the same technique illustrated in FIGS. 3A–3E.

Figure 24:
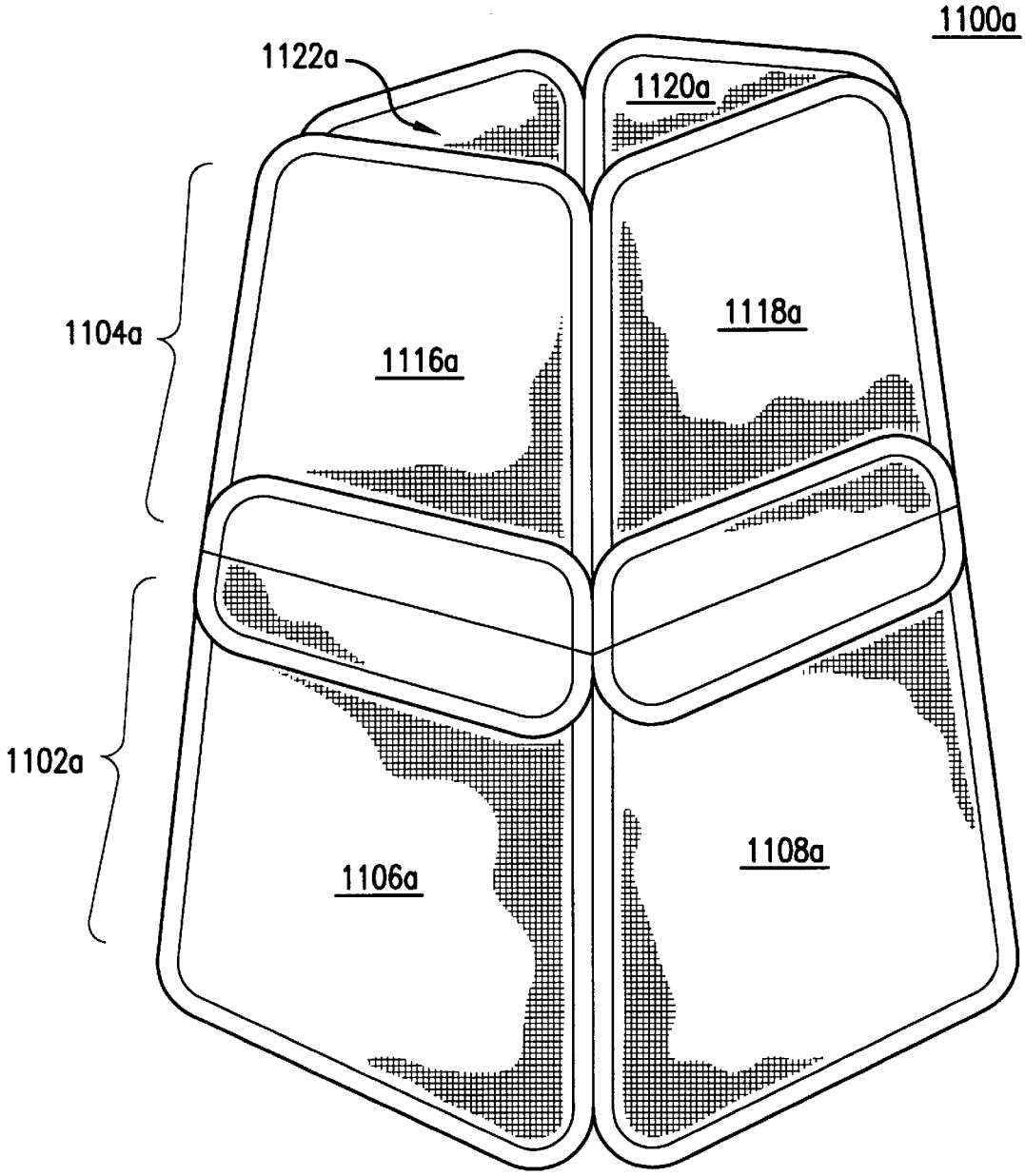
FIGS. 24 and 25 are perspective views of collapsible structures that incorporate various modifications to and variations of the basic structure illustrated in FIGS. 4 and 5, and the principles illustrated in FIGS. 18A–22.

Structure 1110*a* in FIG. 24 illustrates modifications to the structure 1100. The elements of the structure 1100*a* that are the same as the elements of the structure 1100*a* are provided with the same numeral designations except that an "a" has been added to the numeral designations in FIG. 23. The side panels 1106*a*, 1108*a*, 1110*a*, 1112*a* of lower module 1102*a* are connected to each other by stitching (see FIGS. 2A and 2B) or detachable connections, and the side panels 1116*a*, 1118*a*, 1120*a*, 1122*a* of upper module 1104*a* are connected to each other by stitching or detachable connections. The bottom edge of each side panel 1116*a*, 1118*a*, 1120*a*, 1122*a* of upper module 1104*a* is connected to the top edge of the corresponding side panel 1106*a*, 1108*a*, 1110*a*, 1112*a*, respectively, of lower module 1102*a* in the overlapping manner described above for panels 1052, 1054. The structure 1100*a* can be folded and collapsed using the same technique illustrated in FIGS. 6A–6D. Alternatively, if the vertical rows of panels 1106*a* and 1116*a*, 1108*a* and 1118*a*, 1110*a* and 1120*a*, and 1112*a* and 1122*a* can be separated, then the structure 1100*a* can be folded and collapsed using the same technique as structure 50*d* of FIG. 10.

Figure 25:
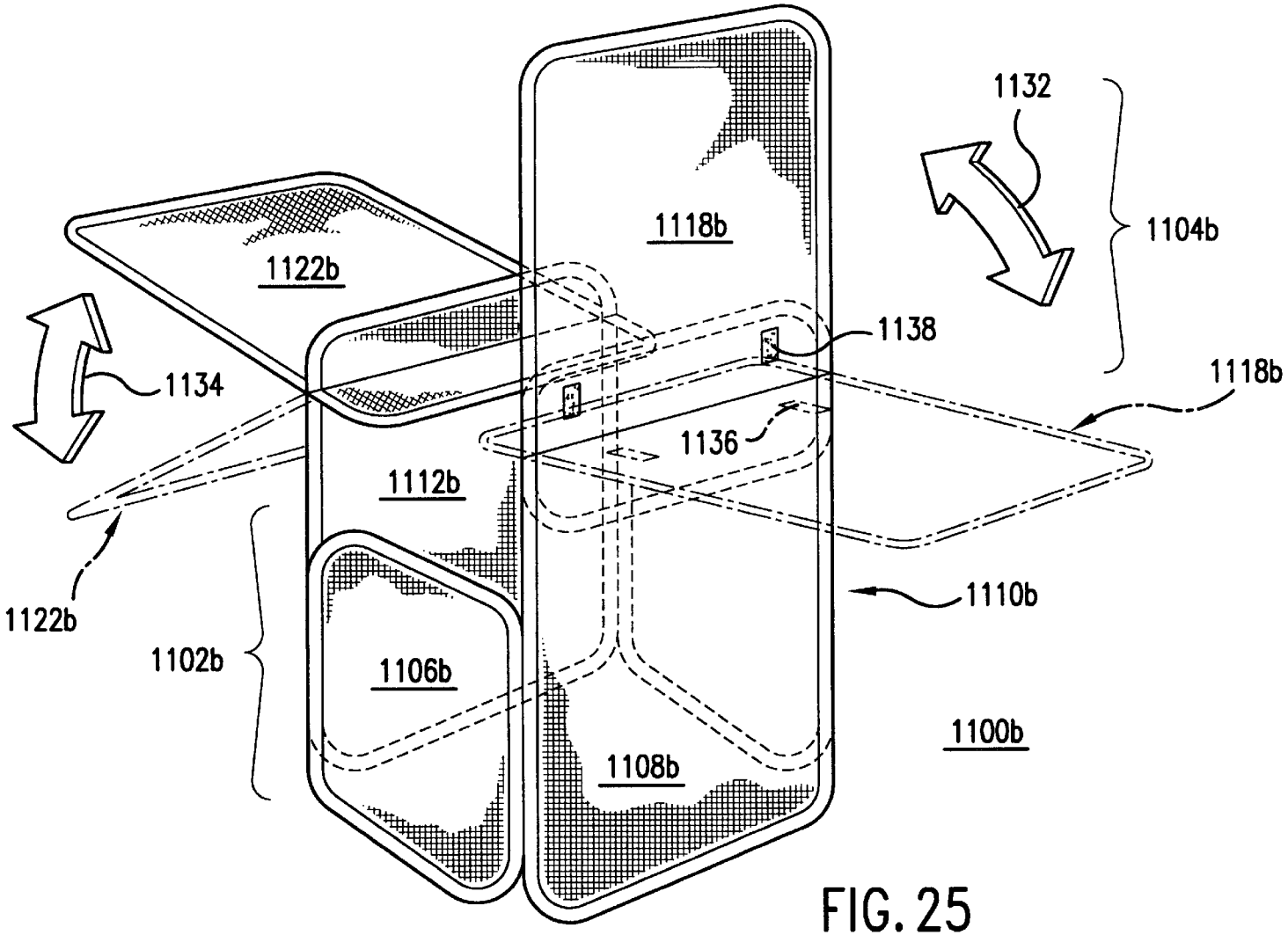

Structure 1110*b* in FIG. 25 illustrates modifications to the structure 1100*a*. The elements of the structure 1100*b* that are the same as the elements of the structure 1100*a* are provided with the same numeral designations except that a "b" has been added to the numeral designations in FIG. 25. The side panels 1116*a* and 1120*a* in the upper module 1104*b* have been omitted, and the height of the side panel 1106*b* in lower module 1102*b* has been shortened. In addition, opposing detachable attachment mechanisms 1136 and 1138 are provided on interfacing fabric portions of the vertical rows of panels 1108*b* and 1118*b*, and 1112*b* and 1122*b*. Therefore, the upper panels 1118*b* and 1122*b* can be pivoted about their overlapping connections in the two directions indicated by arrows 1132 and 1134 to assume any position between (1) an upright vertical position with the upper panels 1118*b* and 1122*b* extending above the corresponding lower panels 1106*b* and 1112*b*, and (2) a downward vertical position with the upper panels 1118*b* and 1122*b* folded side-by-side against the lower panels 1108*b* and 1112*b*. The upper panels 1118*b* and 1122*b* are maintained in their upright vertical position by coupling one detachable attachment mechanism 1136 provided on the side of the fabric of the upper panel (e.g., 1118*b* shown in phantom in the horizontal position) facing the lower panel with an opposing detachable attachment mechanism 1138 provided on the side of the fabric of the lower panel (e.g., 1108*b* shown in phantom) facing the side of the fabric where the detachable attachment mechanism 1136 is provided on the fabric of the upper panel. Similarly, opposing detachable attachment mechanisms can be used to maintain the upper panels 1118*b* and 1122*b* in their downward vertical position against the lower panels 1108*b*, 1112*b*. The structure 1100*b* can be folded and collapsed using the same techniques as structure 1100*a*.

Figure 26:
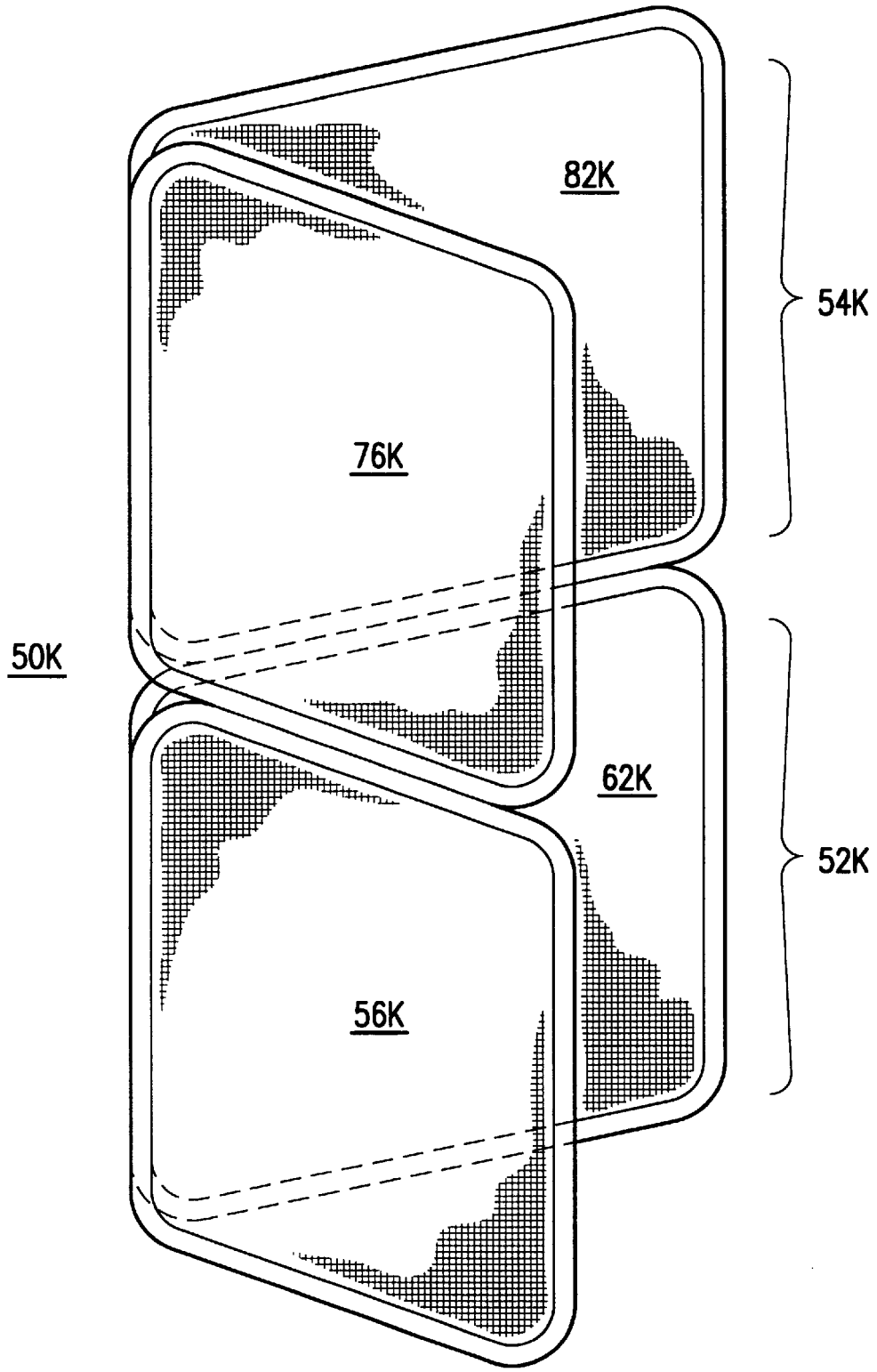
FIG. 26 is a perspective view of a collapsible structure that is a variation of the basic structure illustrated in FIGS. 4 and 5.
Figure 27:
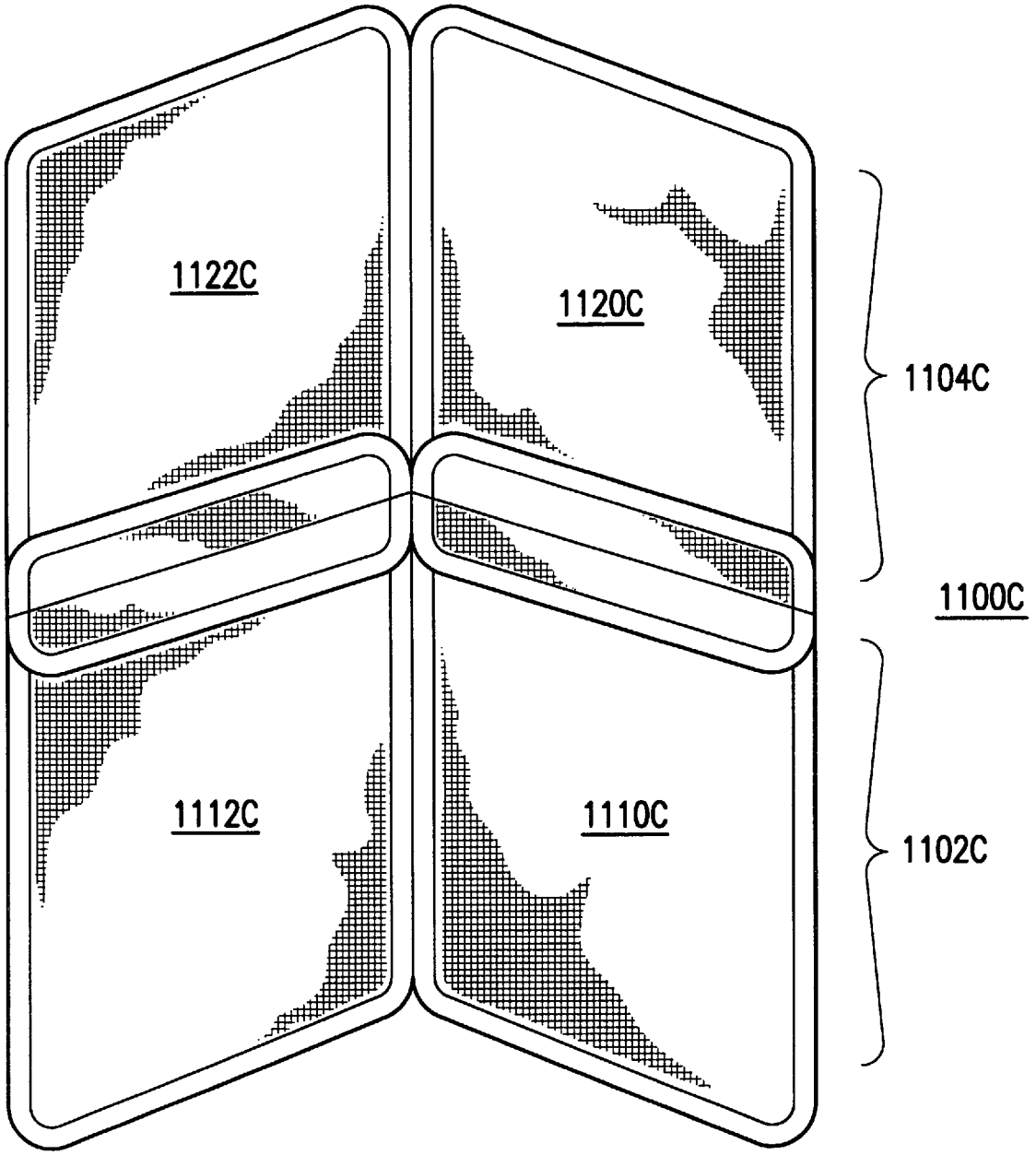
FIG. 27 is a perspective view of a collapsible structure that is a variation of the structure illustrated in FIG. 24.

The wide applicability of the principles of the present invention is further illustrated by the structures in FIGS. 26 and 27. For example, the structure 50*k* in FIG. 26 is essentially the same as structure 50 of FIG. 4, except that two side panels (e.g., 58, 60, 78, 80) from each module 52, 54 have been omitted. The elements of the structure 50*k* that are the same as the elements of the structure 50 are provided with the same numeral designations except that a "k" has been added to the numeral designations in FIG. 26. Thus, structure 50*k* can be used as a wall, a divider, a partition, a support, or for any other purpose.

Structure 50*k* can be folded and collapsed by folding a pair of vertical panels 56*k*, 76*k* against the other pair of vertical panels 62*k*, 82*k* to create one stack of vertical side panels. Then, panels 76*k*, 82*k* can be folded about their hinged connections at the center thereof against the panels 56*k*, 62*k* to create one singular stack of panels, for example, in this order: 82, 76, 56, 62. The combined stack of four panels may then be twisted and folded in the manner described above in connection with FIGS. 3(C)–3(E). Alternatively, if the panels 76*k*, 82*k* are detachably connected to the panels 56*k*, 62*k*, then the panels 76*k*, 82*k* can be detached from the panels 56*k*, 62*k*, and the panels 76*k*, 82*k* placed on top of the panels 56*k*, 62*k* before folding and collapsing the one stack of vertical side panels in the manner described above.

The structure 1100*c* in FIG. 27 extends the principles of FIG. 26 to the structures illustrated in FIGS. 18A–25. The structure 1100*c* in FIG. 27 is essentially the same as structure 1100*a* of FIG. 24, except that two side panels (e.g., 1106*a*, 1108*a*, 1116*a*, 1118a) from each module 1102*a*, 1104*a* have been omitted. The elements of the structure 1100*c* that are the same as the elements of the structure 1100*a* are provided with the same numeral designations except that a "c" has been added to the numeral designations in FIG. 27. Thus, structure 1100*c* can also be used as a wall, a divider, a partition, a support, or for any other purpose.

Structure 1100*c* can be folded and collapsed using the same techniques for structure 50*k*. In addition, if the panels 1110*c*, 1120*c* are detachably connected to the panels 1112*c*, 1122*c*, then the panels 1110*c*, 1120*c* can be detached from the panels 1112*c*, 1122*c*, and the panels 1110*c*, 1120*c* placed on top of the panels 1112*c*, 1122*c* before folding and collapsing the one stack of vertical panels in the manner described above.

In addition, for structures 50*k* and 1100*c*, it is also possible to provide only one of the two upper side panels (e.g., 76*k* for structure 50*k*, and 1120*c* for structure 1100*c*), so that the other upper side panel (e.g., 82*k* and 1122*c*, respectively) is omitted. This provides a divider, partition, wall or other structure having a different configuration for different intended uses or purposes. Other variations are also possible. In general, the lower module can have any number of side panels, with the upper module having less than or the same number of side panels as the lower module.

Those skilled in the art will appreciate that any of the features shown in any of the embodiments of the present invention can be used in any of the other embodiments. As a non-limiting example, nets, openings and other play features can be provided with any of the modules, on any side panel, and on either the interior or exterior of the side panels. As another example, the use of detachable connectors 1136, 1138 in the manner illustrated in FIG. 25 to retain the upper panel (such as 1118*b*) in different vertical positions can also be applied to the other embodiments of the present invention.

Moreover, it is possible to provide structures having three or more side panels that are vertically oriented to provide one side of a structure, as illustrated in FIG. 8A. In other words, each side of a structure according to the present invention can be defined by two, three or more side panels arranged in a vertical manner one on top of the other.

Thus, the embodiments of the present invention increase the applications and use of the collapsible structures to provide the user with an unlimited source and variety of fun and entertainment. The shapes and sizes of the panels and the structures can be varied or combined, as well as the entertainment features. These embodiments further illustrate the versatility of the basic modules 20 and 1020 of the present invention, in that these basic modules 20 and 1020 can be used to form the basis for numerous structures that offer an unlimited variety of entertainment and other purposes.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure adapted to be supported on a surface and comprising:

a lower module having:

a first panel and a second panel, each panel having a foldable frame member having a folded and an unfolded orientation, with a fabric material covering portions of the frame member to form the panel when the frame member is in the unfolded orientation, each panel further including a first side, a second side, a bottom side and a top side, with the first side of the first panel coupled to the second side of the second panel; and an upper module having:

a third panel and a fourth panel, each of the third and fourth panels having a foldable frame member having a folded and an unfolded orientation, with a fabric material covering portions of the frame member to form the third and fourth panel when the frame member is in the unfolded orientation, each of the third and fourth panel further including a first side, a second side, a bottom side and a top side, with the first side of the third panel coupled to the second side of the fourth panel; and wherein the bottom side of the third panel is coupled to the top side of the first panel, and the bottom side of the fourth panel is coupled to the top side of the second panel; and wherein the third and fourth panels are generally co-planar with the first and second panels, respectively, and with the bottom side of the first and second panels adapted to rest on the surface, when the structure is deployed in use.

2. The structure of claim 1, wherein the first side of the first and third panels is hingedly coupled to the second side of the second and fourth panels, respectively.

3. The structure of claim 1, wherein the bottom side of the third and fourth panels are hingedly coupled to the top side of the first and second panels, respectively.

4. The structure of claim 1, wherein the bottom side of the third and fourth panels are stitched to the top side of the first and second panels, respectively.

5. The structure of claim 1, further including detachable connectors for coupling the bottom side of the third and fourth panels to the top side of the first and second panels, respectively.

6. The structure of claim 1, further including a detachable connector for coupling the bottom side of the third panel to the top side of the first panel, and wherein the bottom side of the fourth panel is stitched to the top side of the second panel.

7. The structure of claim 1, wherein the structure further includes detachable connectors for coupling the first side of the third panel to the second side of the fourth panel.

8. The structure of claim 7, wherein the first side of the first panel is stitched to the second side of the second panel.

9. The structure of claim 1, further including a fifth panel having a bottom side coupled to the top side of the third panel.

10. The structure of claim 9, further including a sixth panel having a bottom side coupled to the top side of the fourth panel.

11. The structure of claim 1:

wherein the lower module further includes a fifth panel and a sixth panel, each of the fifth and sixth panels having a foldable frame member having a folded and an unfolded orientation, with a fabric material covering portions of the frame member to form the fifth and sixth panel when the frame member is in the unfolded orientation, each of the fifth and sixth panels further including a first side, a second side, a bottom side and a top side, with the first side of the sixth panel coupled to the second side of the first panel, and the first side of the fifth panel coupled to the second side of the sixth panel; and wherein the upper module further includes a seventh panel and an eighth panel, each of the seventh and eighth panels having a foldable frame member having a folded and an unfolded orientation, with a fabric material covering portions of the frame member to form the seventh and eighth panel when the frame member is in the unfolded orientation, each of the seventh and eighth panels further including a first side, a second side, a bottom side and a top side, with the first side of the eighth panel coupled to the second side of the third panel, and the first side of the seventh panel coupled to the second side of the eighth panel; and wherein the bottom side of the seventh panel is coupled to the top side of the fifth panel, and the bottom side of the eighth panel is coupled to the top side of the sixth panel.

12. The structure of claim 11, wherein the seventh and eighth panels are generally co-planar with the fifth and sixth panels, respectively, when the structure is deployed in use.

13. The structure of claim 1, further including a dividing panel having sides that are coupled to the top sides of the panels of the lower module.

14. A collapsible structure adapted to be supported on a surface and comprising:

a lower module having a plurality of panels, each panel having a foldable frame member having a folded and an unfolded orientation, with a fabric material covering portions of the frame member to form the respective panel when the frame member is in the unfolded orientation, each panel further including a first side, a second side, a bottom side and a top side, with the first side of each panel coupled to the second side of an adjacent panel; and an upper module having a plurality of panels, each panel of the upper module having a foldable frame member having a folded and an unfolded orientation, with a fabric material covering portions of the frame member to form the respective panel of the upper module when the frame member is in the unfolded orientation, each panel of the upper module further including a first side, a second side, a bottom side and a top side, with the first side of each panel of the upper module coupled to the second side of an adjacent panel of the upper module;

wherein the bottom side of each panel of the upper module is coupled to the top side of a corresponding panel of the lower module; and wherein each panel of the upper module is generally co-planar with the corresponding panel of the lower module, and with the bottom side of the panels of the lower module adapted to rest on the surface, when the structure is deployed in use.

15. The structure of claim 14, wherein the lower module has four panels, with each of the four panels of the lower module coupled along their first and second sides to form a ring of panels that enclose an inner space.

16. The structure of claim 15, wherein the upper module has four panels, with each of the four panels of the upper module coupled along their first and second sides to form a ring of panels that enclose an inner space.

17. The structure of claim 14, wherein the first side of each panel of the lower module is hingedly coupled to the second side of each panel of the lower module.

18. The structure of claim 14, wherein the bottom side of each panel of the upper module is hingedly coupled to the top side of a corresponding panel of the lower panel.

19. The structure of claim 14, wherein the bottom side of each panel of the upper module is stitched to the top side of a corresponding panel of the lower panel.

20. The structure of claim 14, further including detachable connectors for coupling the bottom side of each panel of the upper module to a corresponding panel of the lower module.

21. The structure of claim 14, wherein the structure further includes detachable connectors for coupling the first side of each panel of the upper module to the second side of an adjacent panel of the upper module.

22. The structure of claim 14, wherein the first side of each panel of the lower module is stitched to the second side of an adjacent panel of the lower module.

23. The structure of claim 14, further including a top panel having a bottom side coupled to the top side of one of the panels of the upper module.

24. The structure of claim 23, further including a second top panel coupled to the top panel, the second top panel further having a bottom side coupled to the top side of another panel of the upper module.

25. The structure of claim 14, further including a dividing panel having sides that are coupled to the top sides of the panels of the lower module.

* * * * *